US006726506B2

(12) United States Patent
Fukumori et al.

(10) Patent No.: US 6,726,506 B2
(45) Date of Patent: Apr. 27, 2004

(54) FUSE HOLDER

(75) Inventors: Shuichi Fukumori, Brussels (BE); Sonny Van Dessel, Haacht (BE)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/080,151

(22) Filed: Feb. 19, 2002

(65) Prior Publication Data

US 2002/0115348 A1 Aug. 22, 2002

(30) Foreign Application Priority Data

Feb. 22, 2001 (JP) ..... 2001-047354

(51) Int. Cl.[7] ..... H01R 13/68
(52) U.S. Cl. ..... 439/621; 439/608; 361/767
(58) Field of Search ..... 439/621, 82, 83, 439/717, 856, 857, 594, 337; 361/767

(56) References Cited

U.S. PATENT DOCUMENTS

| | | | | | |
|---|---|---|---|---|---|
| 3,378,808 | A | * | 4/1968 | French | 439/492 |
| 3,848,951 | A | * | 11/1974 | Michaels et al. | 439/357 |
| 4,094,564 | A | | 6/1978 | Cacolici | |
| 4,184,733 | A | * | 1/1980 | Schmeling | 439/717 |
| 4,230,387 | A | | 10/1980 | Zahn | |
| 4,391,482 | A | * | 7/1983 | Czeschka | 439/590 |
| 4,466,683 | A | * | 8/1984 | Ballarini | 439/571 |
| 4,560,227 | A | | 12/1985 | Bukala | |
| 4,943,248 | A | * | 7/1990 | Colleran et al. | 439/850 |
| 4,944,684 | A | | 7/1990 | Leibowitz | |
| 5,194,018 | A | | 3/1993 | Lopata et al. | |
| 5,281,171 | A | | 1/1994 | Job | |
| 5,409,399 | A | * | 4/1995 | Geoghegan et al. | 439/567 |
| 5,552,951 | A | * | 9/1996 | Pasch et al. | 361/56 |
| 5,632,654 | A | | 5/1997 | Sugiura | |
| 5,752,856 | A | | 5/1998 | Boutin et al. | |
| 5,785,537 | A | * | 7/1998 | Donahue et al. | 439/79 |
| 5,926,952 | A | | 7/1999 | Ito | |
| 6,089,918 | A | * | 7/2000 | Arakelian et al. | 439/621 |
| 6,280,253 | B1 | * | 8/2001 | Kraus et al. | 439/621 |
| D461,781 | S | | 8/2002 | Fukumori et al. | |
| D462,061 | S | | 8/2002 | Fukumori et al. | |
| 6,482,050 | B1 | * | 11/2002 | Lemke et al. | 439/856 |
| 6,533,614 | B1 | * | 3/2003 | Akama et al. | 439/608 |

FOREIGN PATENT DOCUMENTS

| | | |
|---|---|---|
| JP | 59-151729 | 8/1984 |
| JP | 63-188977 | 12/1988 |
| JP | 2-3635 | 1/1990 |
| JP | 4-62775 | 2/1992 |
| JP | 4-52351 | 4/1992 |
| JP | 05342979 | 12/1993 |
| JP | 06150806 | 5/1994 |

(List continued on next page.)

OTHER PUBLICATIONS

"Fuse Holder", by Shuichi Fukumori et al., U.S. patent application 10/080,149; Feb. 19, 2002, pp. 1 to 21 and 23 sheets of drawings.
"Multiple Fuse Holder", by Shuichi Fukumori et al., U.S. patent application 10/080,154; Feb. 19, 2002, pp. 1 to 27 and 34 sheets of drawings.

*Primary Examiner*—Tho D. Ta
*Assistant Examiner*—Larisa Tsukerman
(74) *Attorney, Agent, or Firm*—W. F. Fasse; W. G. Fasse

(57) ABSTRACT

A fuse holder includes: a holder housing, in which a chamber for holding blade terminals and at least a part of the body of a fuse is formed with wide walls at the front and the rear and narrow walls on the right and the left; two coupling parts, which are provided on the holder housing to disconnectably fit the holder housing onto holder housings of two other adjacent fuse holders; and two contacts, each of which has an intermediate part fixed to the holder housing, a connecting part, at one end, extending into the chamber to fit with a blade terminal of the fuse, and a leg, at the other end, extending out of the holder housing to be soldered or press-fitted onto a printed circuit board.

20 Claims, 28 Drawing Sheets

FOREIGN PATENT DOCUMENTS

| | | |
|---|---|---|
| JP | 06231672 | 8/1994 |
| JP | 7-25554 | 5/1995 |
| JP | 8-8551 | 3/1996 |
| JP | 09245611 | 9/1997 |
| JP | 10106697 | 4/1998 |
| JP | 2000011850 | 1/2000 |
| JP | 2000215784 | 8/2000 |
| JP | 2000299167 | 10/2000 |
| JP | 2000353576 | 12/2000 |
| WO | DM/054992 | 3/2001 |

* cited by examiner

FUSE HOLDER

CROSS-REFERENCE TO RELATED APPLICATIONS

This application is related to our copending U.S. Patent Applications: 10/080,149 and 10/080,154, both filed on Feb. 19, 2002.

BACKGROUND OF THE INVENTION

1. Field of the Invention

The present invention relates to a fuse holder, into which a blade type fuse, with blade terminals protruding from its body, is fitted.

2. Related Art

A fuse fitting device, into which a blade type fuse is fitted, is known. This device comprises a block of synthetic resin, and connecting terminals, which are inserted from below into a chamber in the block and fitted to a lance of the block. When this fuse fitting device is to be used, electric wires are connected to the connecting terminals, these connecting terminals are inserted into the chamber of the block and fitted to the lance, a fuse is inserted from above into the chamber of the block, and the blade terminals of the fuse are fitted into the connecting terminals to make connection (for example, refer to Japanese Patent unexamined publication gazette Heisei 6-150806).

When a plurality of fuses are to be fitted into this fuse fitting device, a new block must be newly designed whenever the number of fuses to be used is modified. It is inevitable to produce a mold for the block in each occasion, and in turn, the production of the fuse fitting device is costly.

SUMMARY OF THE INVENTION

The present invention was made in view of these points, and one objective of the invention is to propose a fuse holder, wherein a holder housing is combined with contacts and a plurality of which can be coupled together, use these fuse holders, mount a required number of these fuse holders on a printed circuit board, load the printed circuit board in a casing or the like and produce a fuse fitting device, and easily realize a fuse fitting device for any number of fuses and reduce the production cost of the fuse fitting device. Other objectives include to reduce the production cost by adopting fork-shaped contacts, and to guarantee high performance of the fuse fitting device by supporting these contacts by the holder housing and preventing the contacts from being pried.

To accomplish these objectives, the present invention is a fuse holder, into which a blade type fuse, with blade terminals protruding from the body thereof, is fitted, said fuse holder comprising a holder housing having wide walls at the front and the rear and narrow walls on the right and the left and forming, with these walls, a chamber, which will hold the blade terminals of a fuse inserted from the top side and at least a part of the body of the fuse, two coupling parts, which are provided on the holder housing to disconnectably fit the holder housing onto holder housings of two other adjacent fuse holders, and two contacts, each of which has an intermediate part fixed to the holder housing, a connecting part, at one end, extending into the chamber to fit with a blade terminal, and a leg, at the other end, extending out of the holder housing to be soldered or press-fitted onto a printed circuit board.

When a fuse is fitted into the holder housing of this fuse holder, the blade terminals and at least a part of the body of the fuse will be held in the chamber, and the blade terminals will be fitted into the connecting parts of the contacts. When the fuse holder is coupled, by the coupling parts, to other adjacent fuse holders and the legs of the contacts are soldered or press-fitted onto a printed circuit board, the required number of fuse holders, into which fuses have been fitted, will be mounted on the printed circuit board. When conductive parts such as electric wires are connected to the pattern of the printed circuit board, the fuses will be electrically connected to the conductive parts. When the printed circuit board is loaded into a casing or the like, a fuse fitting device will be produced. When this fuse holder is used, a fuse fitting device can be made with ease for any number of fuses to be used without newly designing a block. Hence the production cost is reduced. To produce a fuse fitting device, a plurality of the fuse holders being coupled to each other with the coupling parts may be mounted onto the printed circuit board before fitting a fuse into each fuse holder.

Accordingly, with the use of the fuse holder of the present invention, a fuse fitting device can be produced easily for any number of fuses to be used by coupling fuse holders of the present invention by the coupling parts, mounting the fuse holders onto a printed circuit board and loading the printed circuit board in a casing or the like, and in turn, the production cost of the fuse fitting device can be reduced.

DESCRIPTION OF PREFERRED EMBODIMENTS OF THE INVENTION

Figure 9:
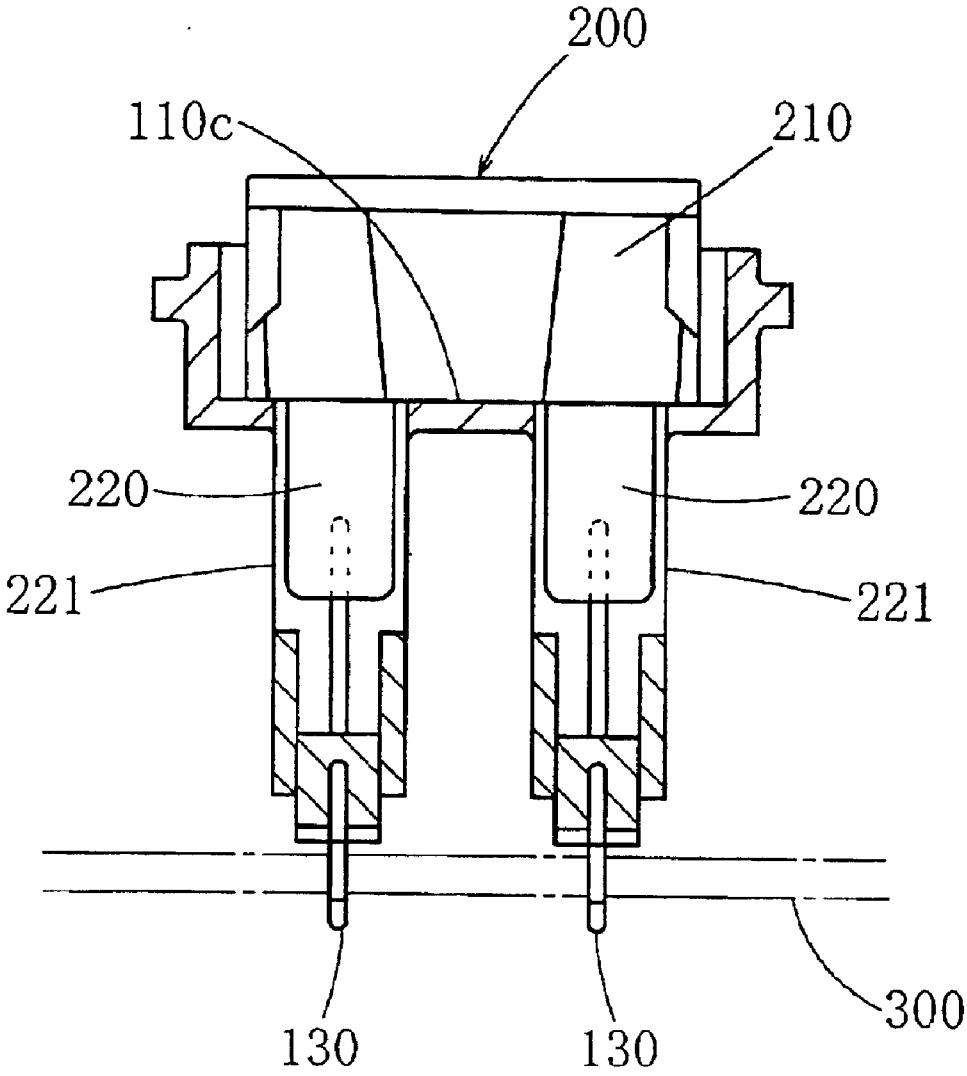
FIG. 9 is a sectional view of the first embodiment of the fuse holder with the fuse being fitted. The fuse holder is cut in both the left wall and the right wall thereof.
Figure 10:
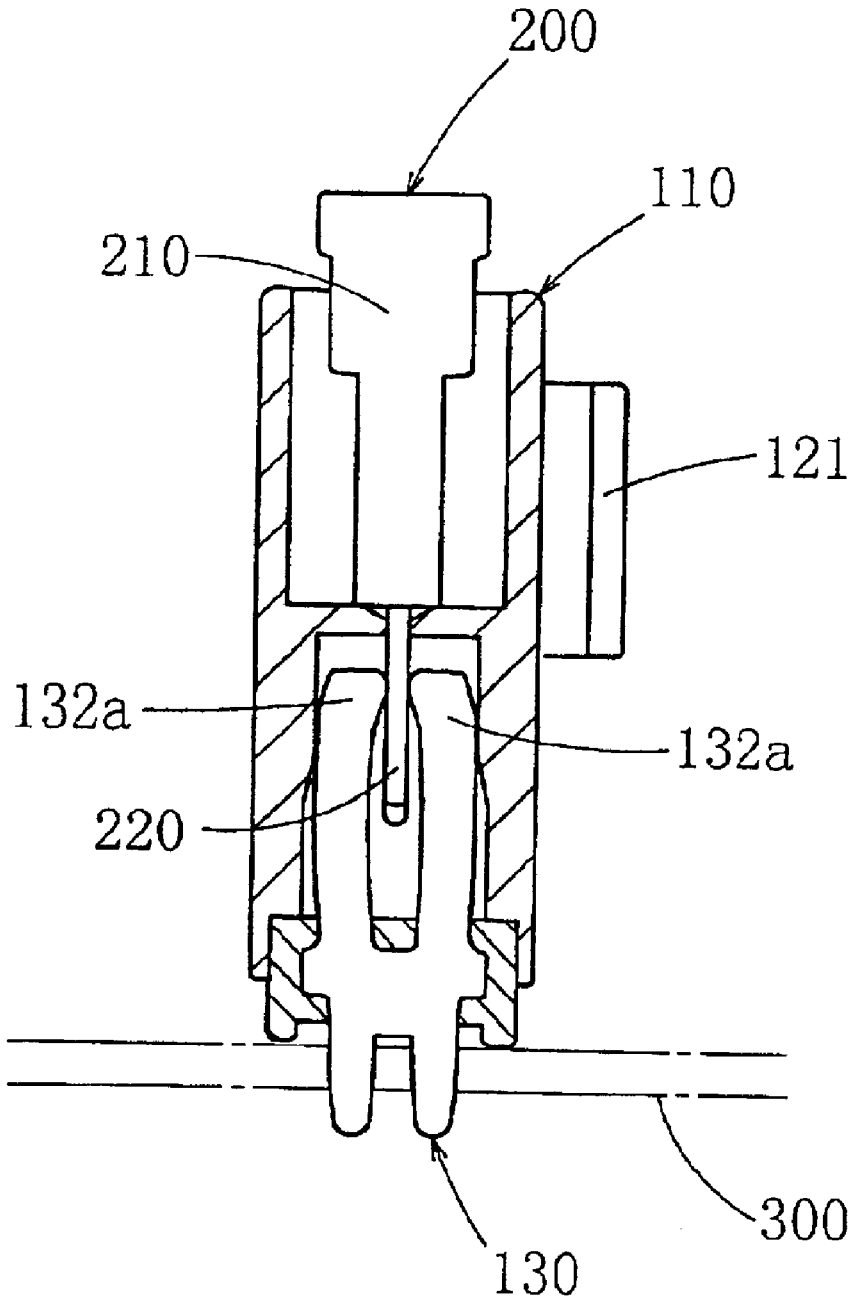
FIG. 10 is a sectional view of the first embodiment of the fuse holder with the fuse being fitted. The fuse holder is cut in both the front wall and the rear wall thereof.
Figure 21:
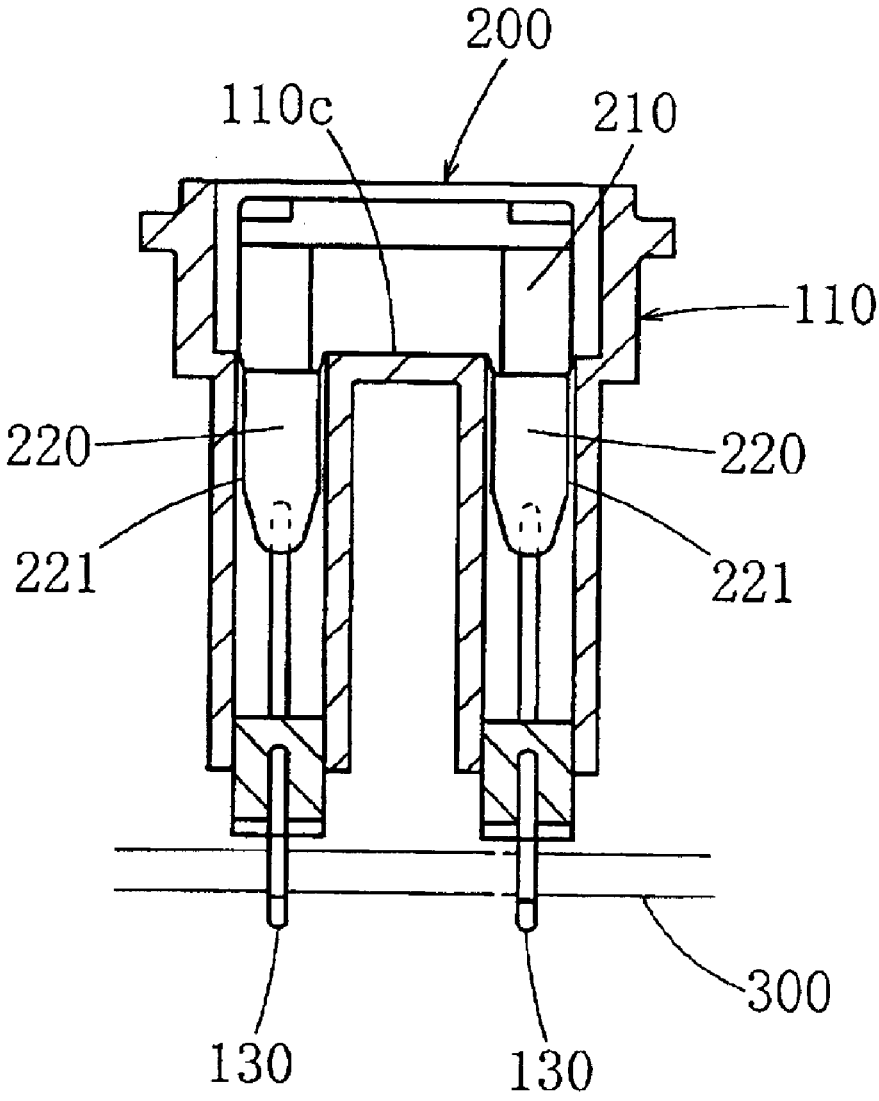
FIG. 21 is a sectional view of the second embodiment of the fuse holder with the fuse being fitted. The fuse holder is cut in both the left wall and the right wall thereof.
Figure 22:
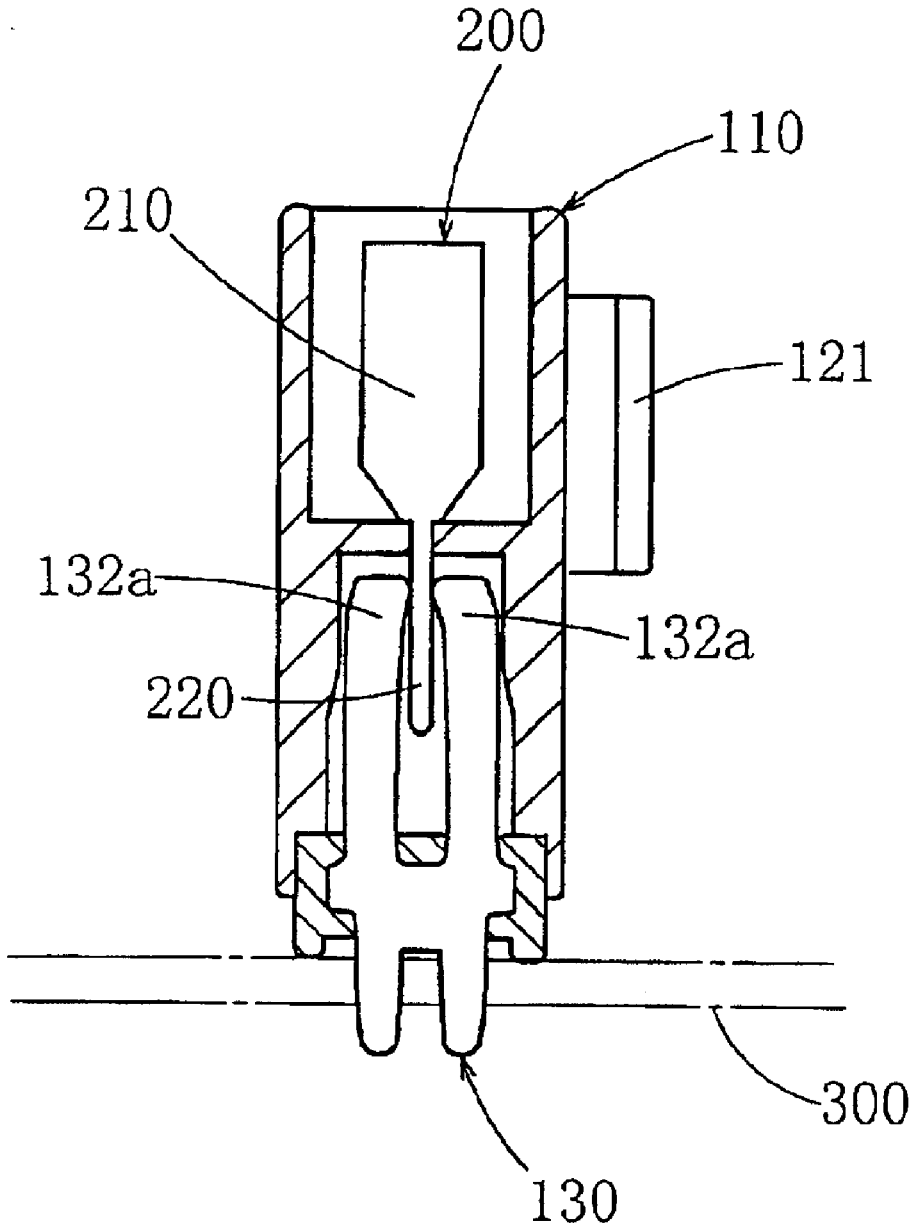
FIG. 22 is a sectional view of the second embodiment of the fuse holder with the fuse being fitted. The fuse holder is cut in both the front wall and the rear wall thereof.
Figure 23:
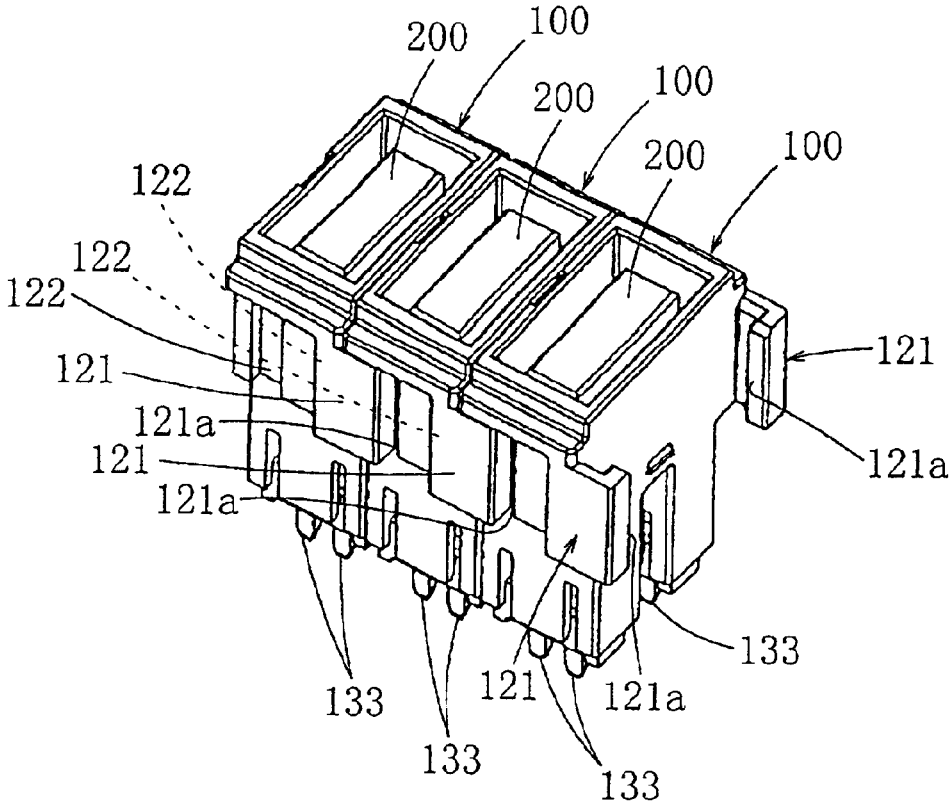
FIG. 23 is a perspective view of the fuse holders of the second embodiment. The fuse folders are coupled to each other, and they are seen from the top side thereof.
Figure 24:
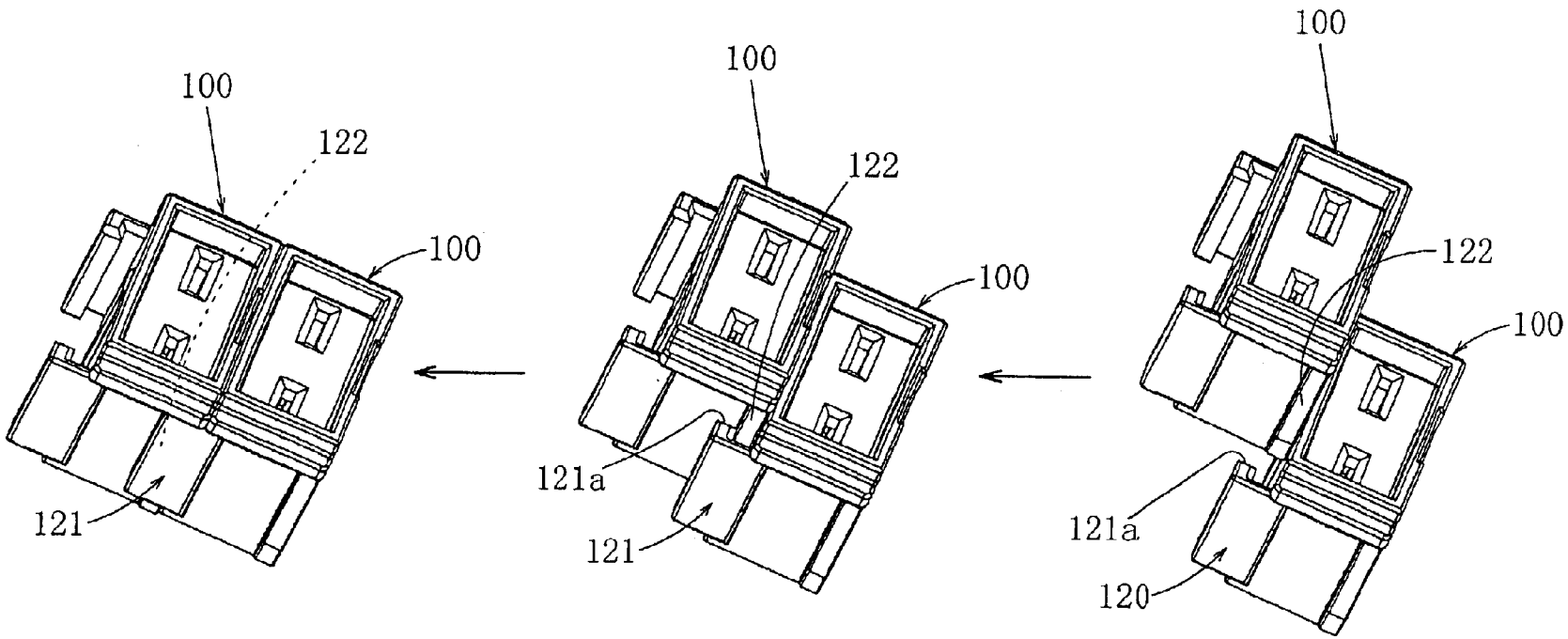
FIG. 24 is a perspective view showing the procedure for coupling the fuse holders of the second embodiment to each other.

In the following, some embodiments of the fuse holder according to the present invention will be described. A fuse to be fitted into this fuse holder is a blade type fuse 200, as shown in FIG. 9 or FIG. 10 and FIG. 21 and FIG. 22, with two blade terminals 220 protruding from the body 210 thereof. These fuses 200 have been standardized. The larger fuse 200 shown in FIG. 9 and FIG. 10 is of the maxi type, and the smaller fuse 200 shown in FIG. 21 and FIG. 22 is of the mini type.

Figure 1:
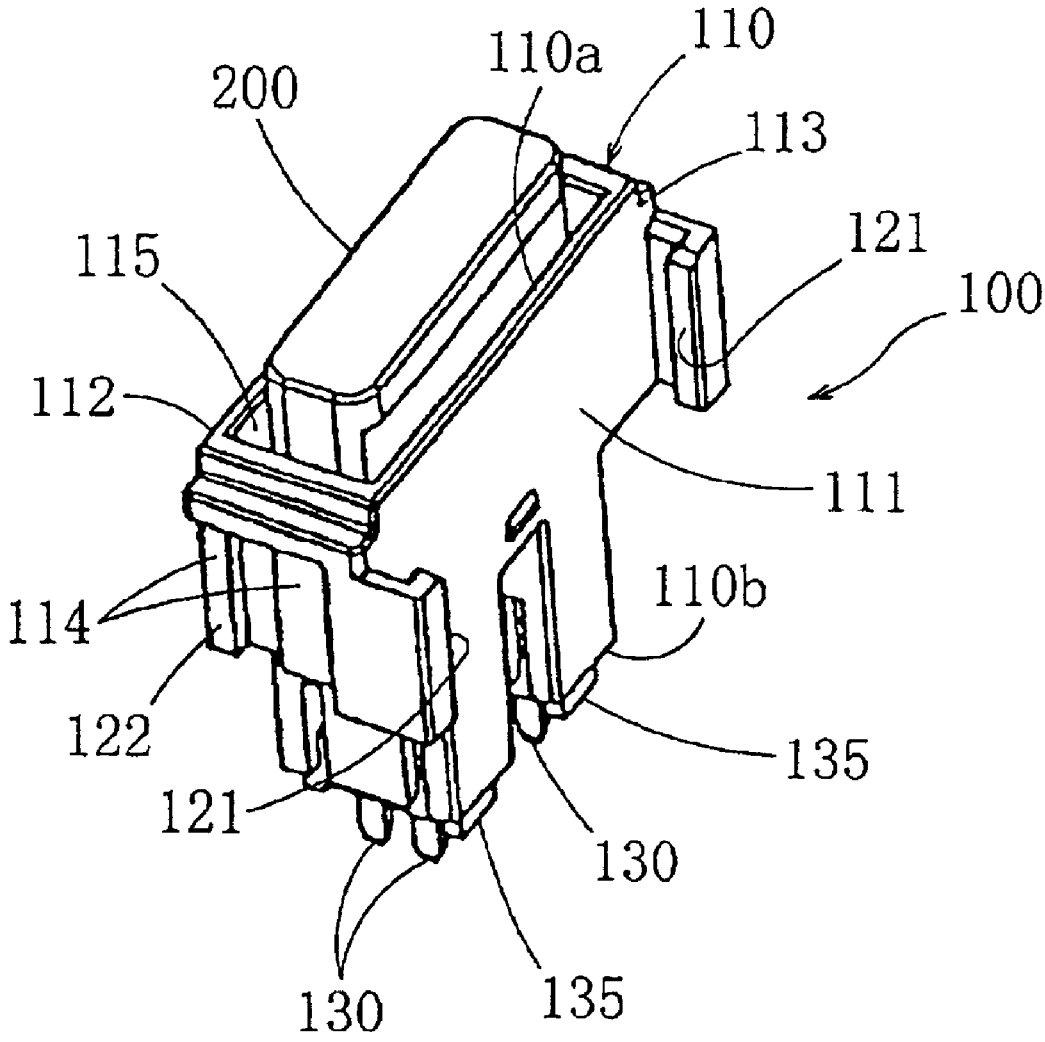
FIG. 1 is a perspective view of the first embodiment of the fuse holder according to the present invention with a fuse being fitted. The fuse holder is seen from the top side thereof.
Figure 2:
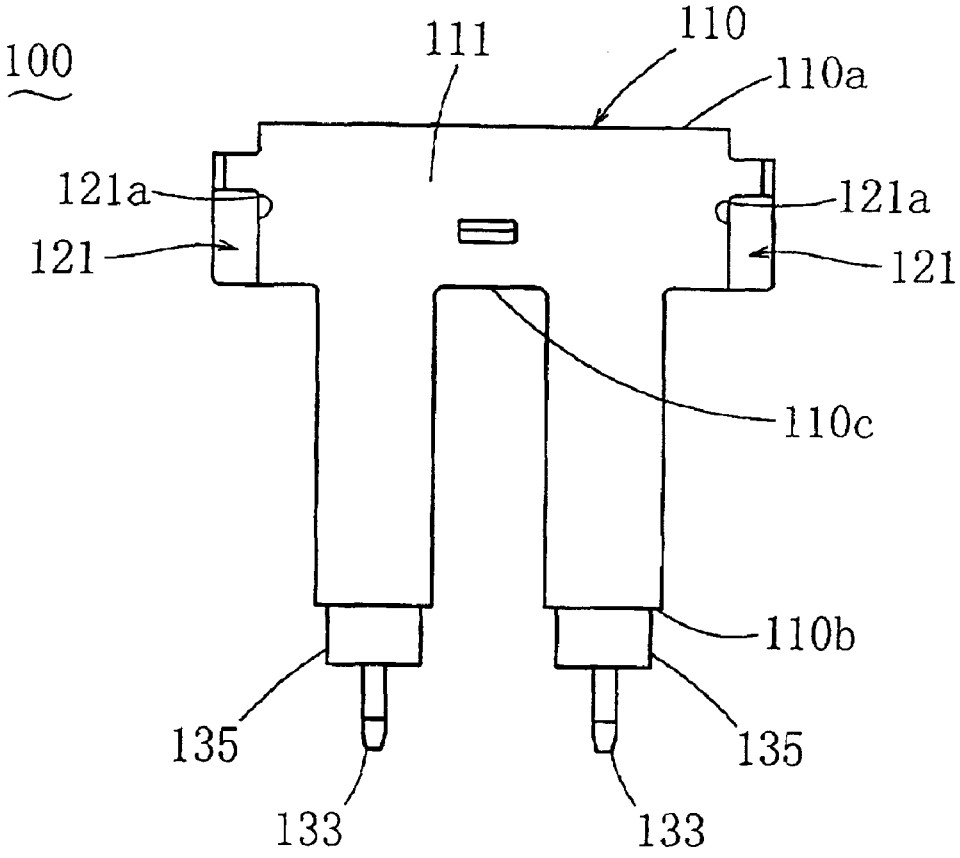
FIG. 2 is a front view of the first embodiment of the fuse holder.
Figure 3:
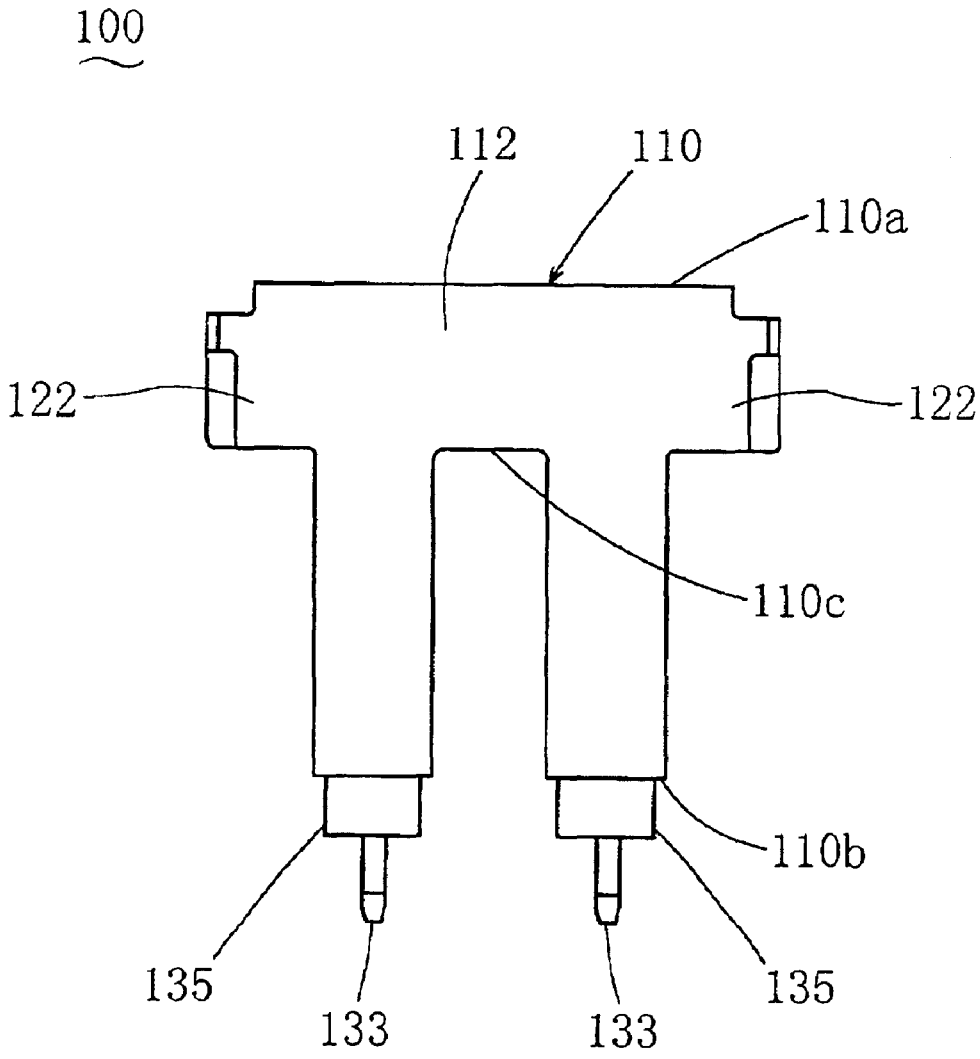
FIG. 3 is a rear view of the first embodiment of the fuse holder.
Figure 4:
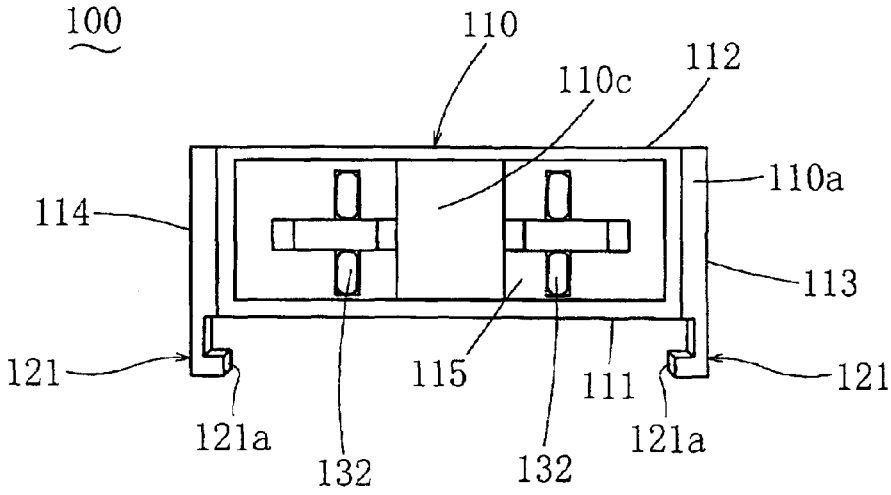
FIG. 4 is a plan view of the first embodiment of the fuse holder.
Figure 5:
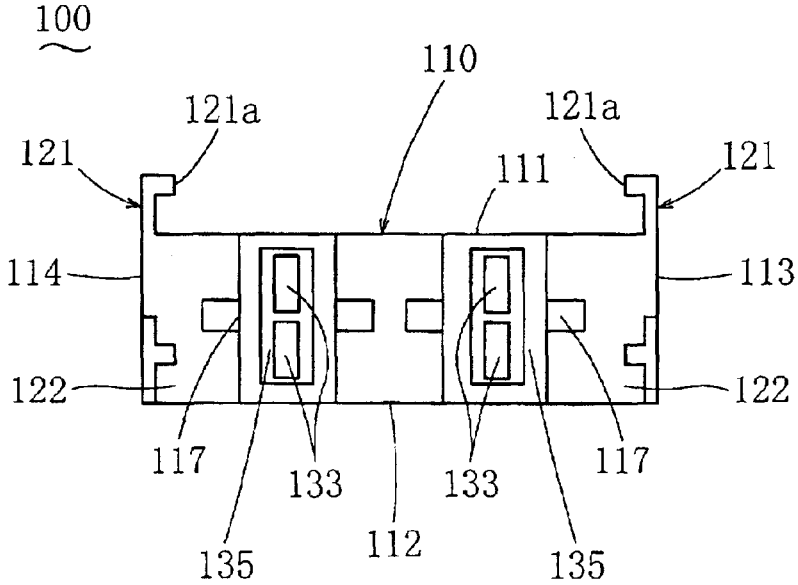
FIG. 5 is a bottom view of the first embodiment of the fuse holder.
Figure 6:
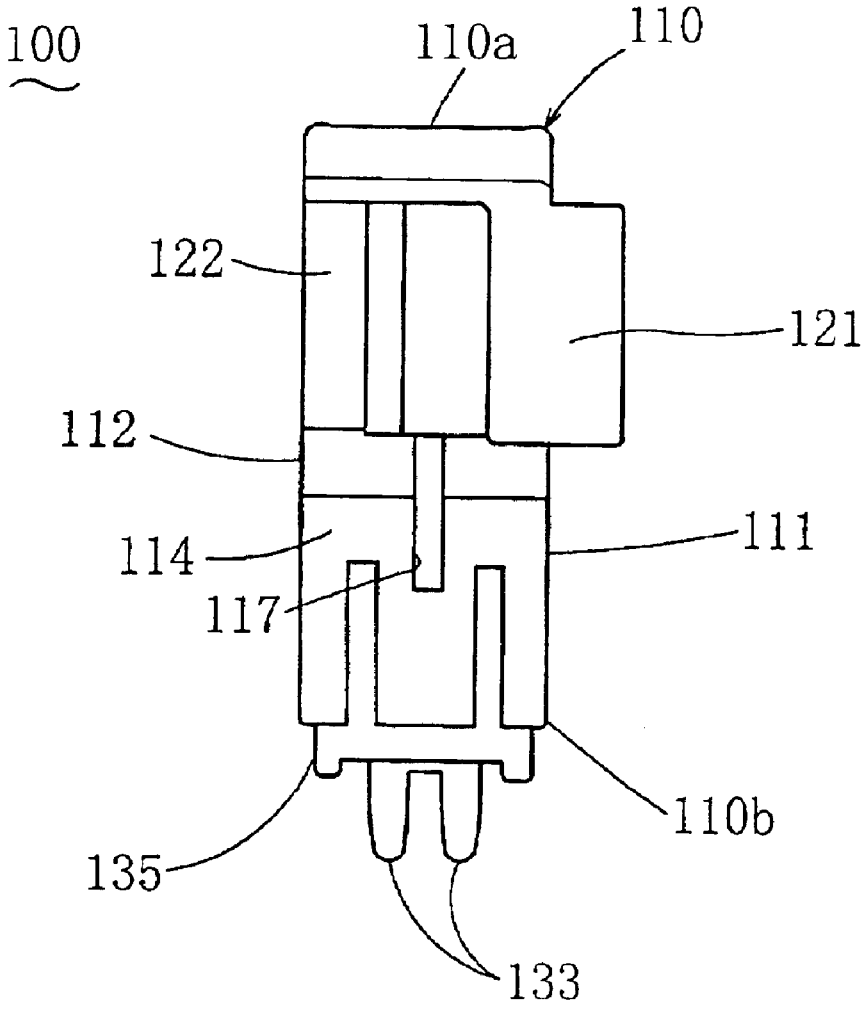
FIG. 6 is a side view of the first embodiment of the fuse holder.
Figure 7:
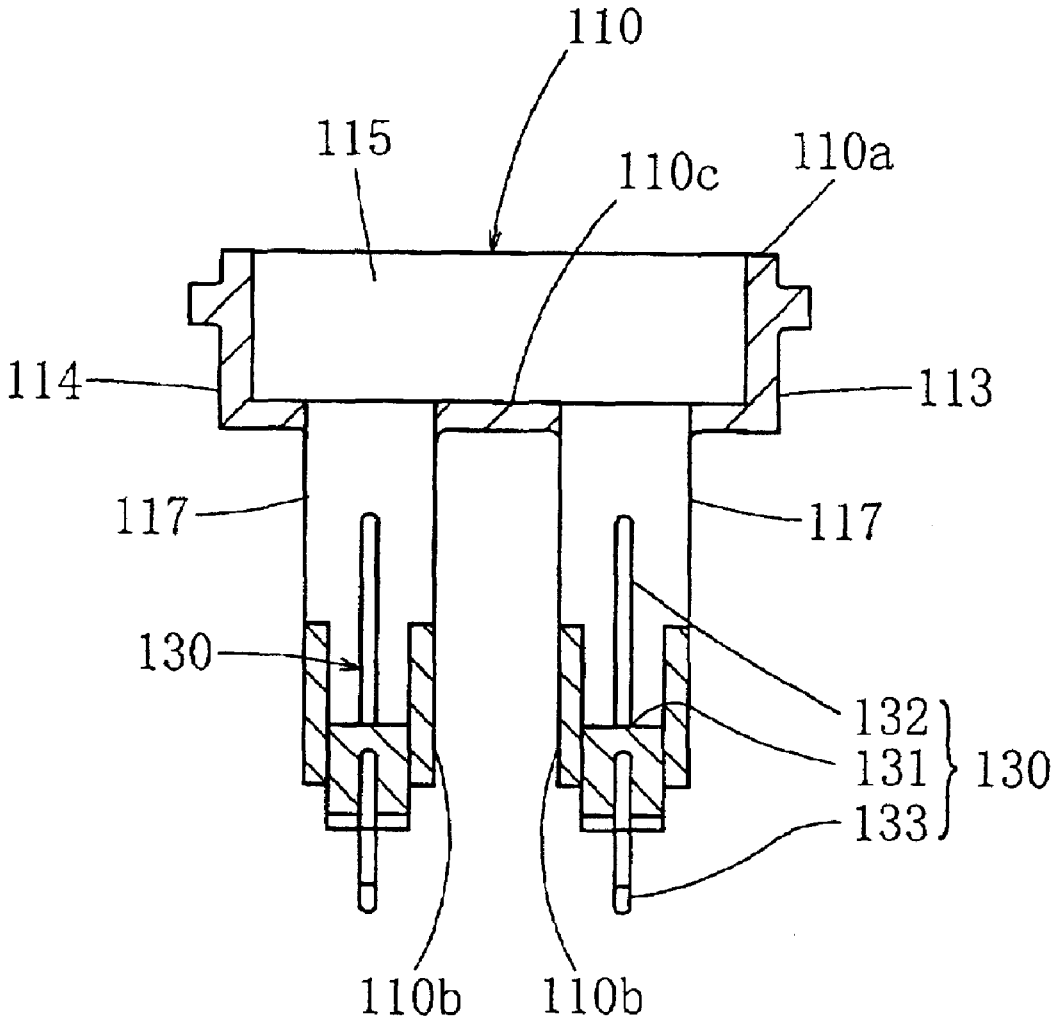
FIG. 7 is a sectional view of the first embodiment of the fuse holder cut in both the left wall and the right wall thereof.
Figure 8:
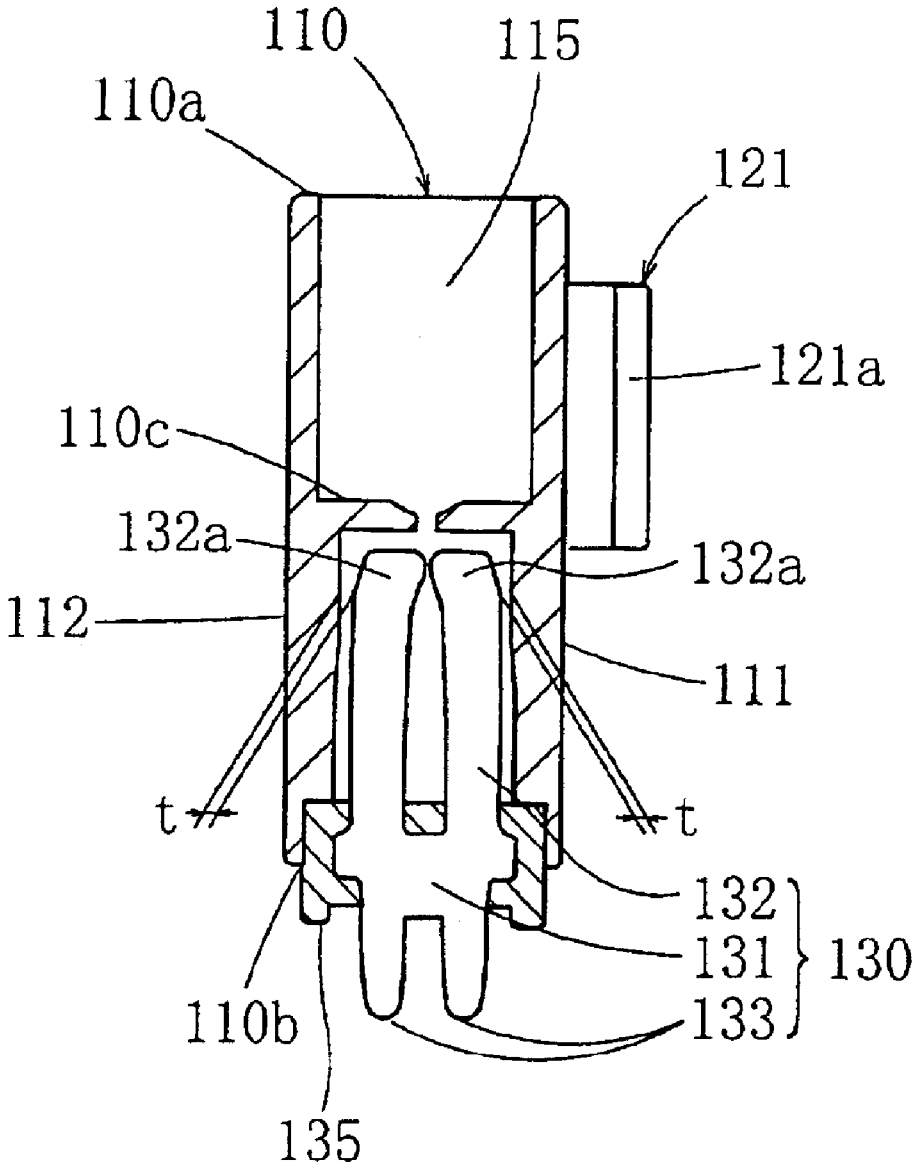
FIG. 8 is a sectional view of the first embodiment of the fuse holder cut in both the front wall and the rear wall thereof.

FIG. 2 through FIG. 8 show the first embodiment fuse holder 100. A fuse 200 of the maxi type is fitted into this fuse holder 100 (please refer to FIG. 1). This fuse holder 100 comprises a holder housing 110 being made of an insulator and two contacts 130 being made of a conductor and provided on the holder housing 110.

The holder housing 110 is provided with wide walls 111, 112 at the front and the rear, and narrow walls 113, 114 on the left and the right thereof. A chamber 115, which is through from the top 110*a* to the bottom 110*b* of the holder housing 110, is formed on the inner sides of the front wall 111, the rear wall 112, the left wall 113 and the right wall 114. The front, rear, left and right herein are used for convenience to indicate relative positional relationships. Accordingly, these directions are not related to the orientations of a printed circuit board 300, onto which the fuse holder 100 is to be mounted, and the casing or the like, into which the printed circuit board 300 is to be loaded. When a fuse 200 is inserted into the holder housing 110 from the top side thereof, the blade terminals 220 of the fuse 200 and at least a part of the body 210 thereof will be held in the chamber 115. A portion of the holder housing 110 from a point between the top 110*a* and the bottom 110*b* and to the top 110*a* overhangs in the direction of alignment of the blade terminals 220. The body 210 of the fuse 200 is held by a horizontal wall 110*c*, which is inside the overhanging part.

Figure 12:
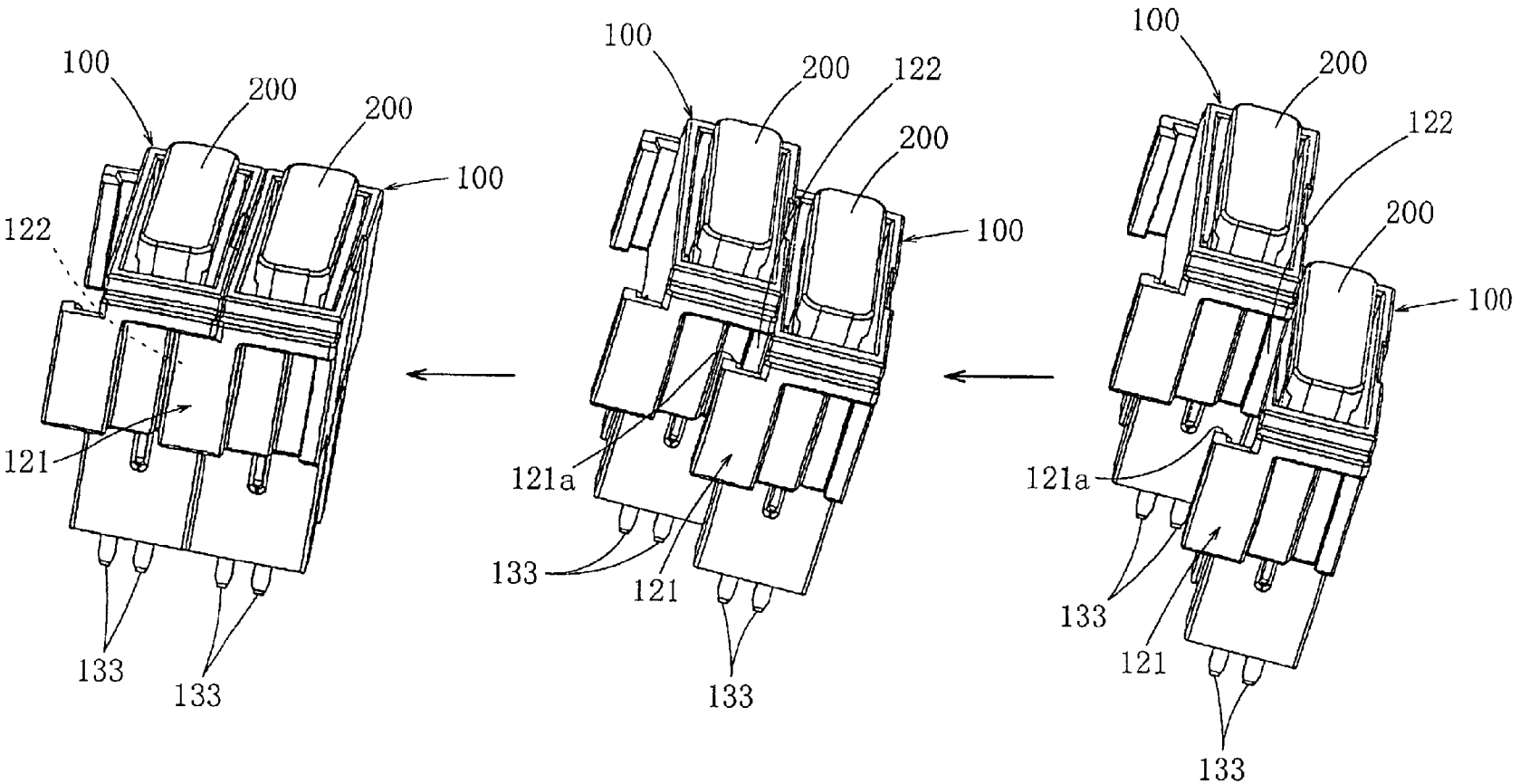
FIG. 12 is a perspective view showing the procedure for coupling the fuse holders of the first embodiment to each other.
Figure 13:
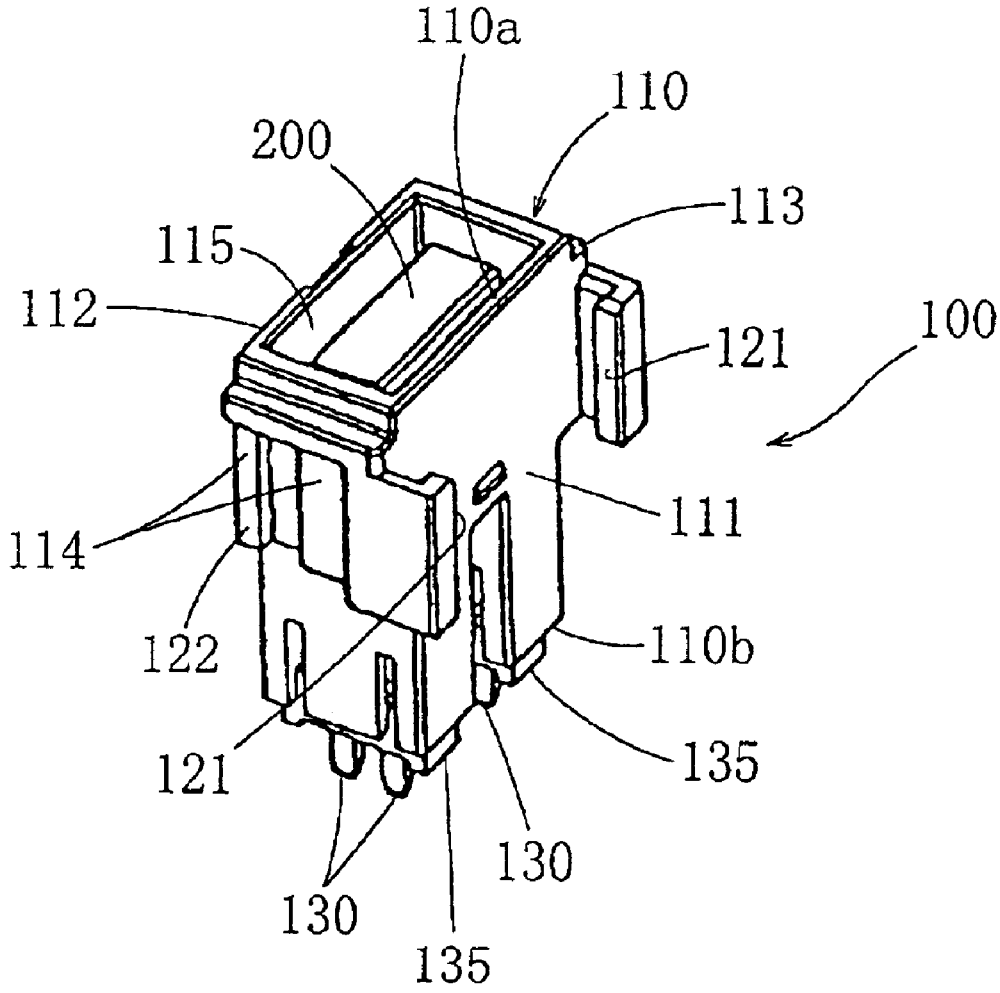
FIG. 13 is a perspective view of the second embodiment of the fuse holder according to the present invention. The fuse holder with a fuse fitted is seen from the top side.
Figure 14:
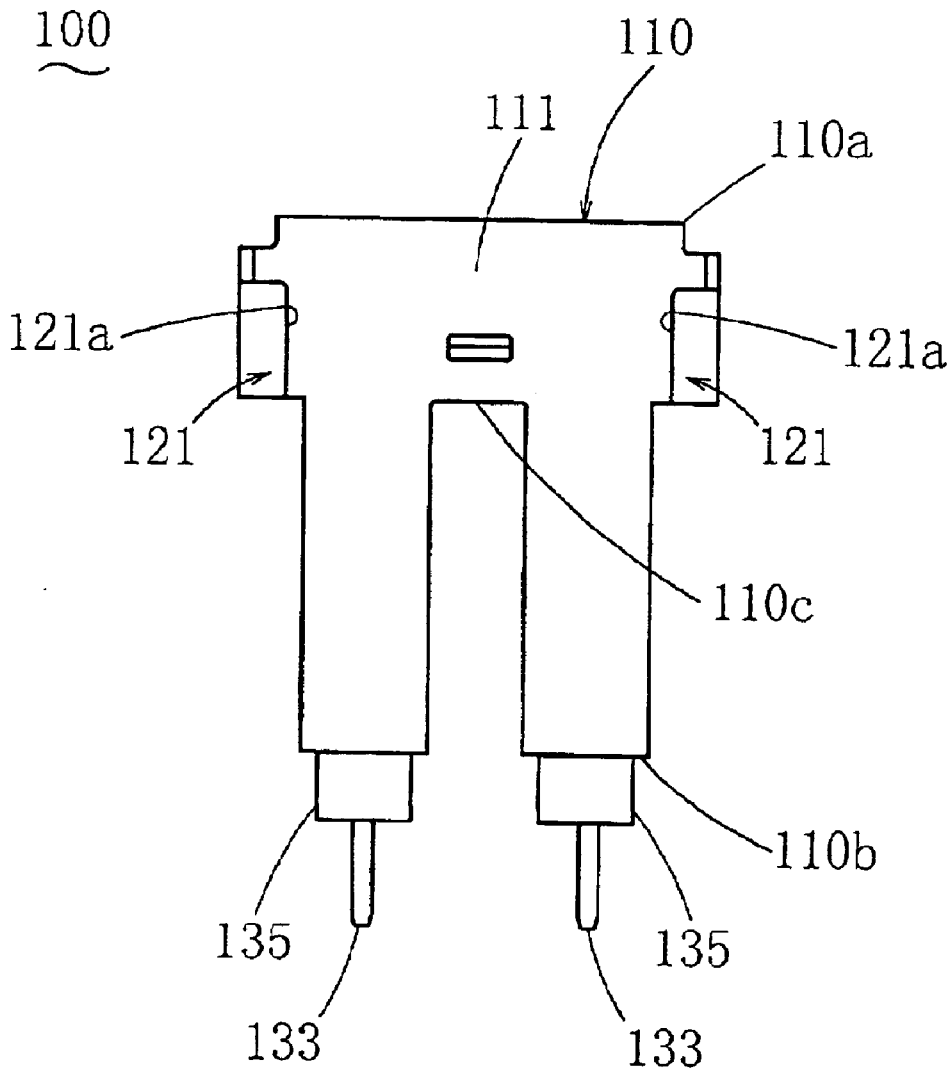
FIG. 14 is a front view of the second embodiment of the fuse holder.
Figure 15:
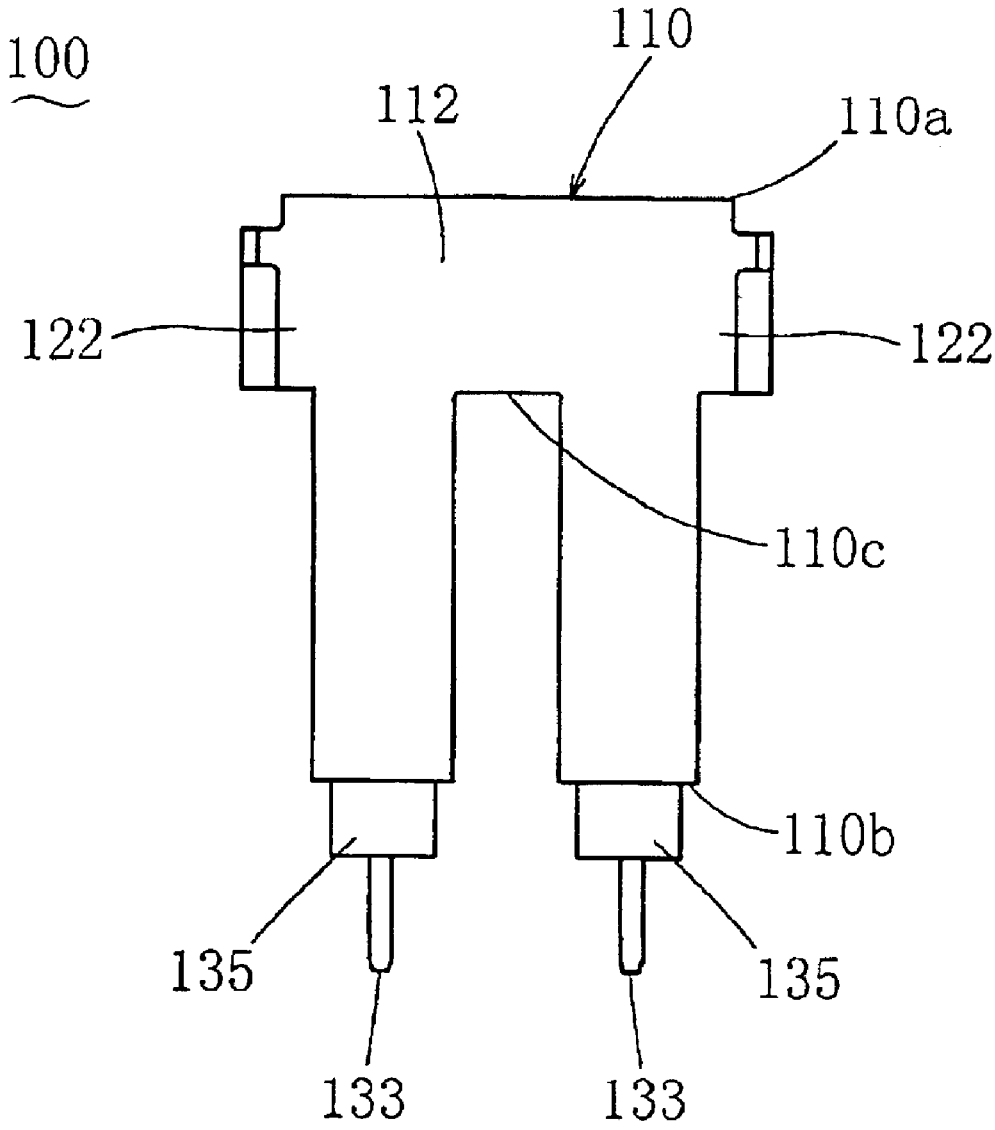
FIG. 15 is a rear view of the second embodiment of the fuse holder.
Figure 16:
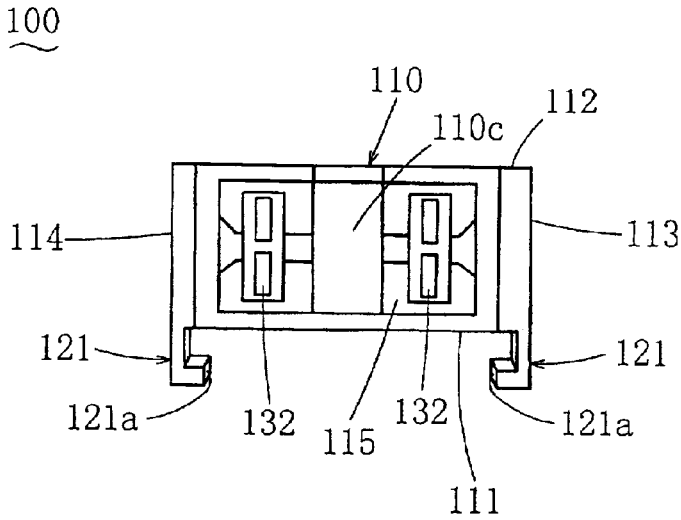
FIG. 16 is a plan view of the second embodiment of the fuse holder.
Figure 17:
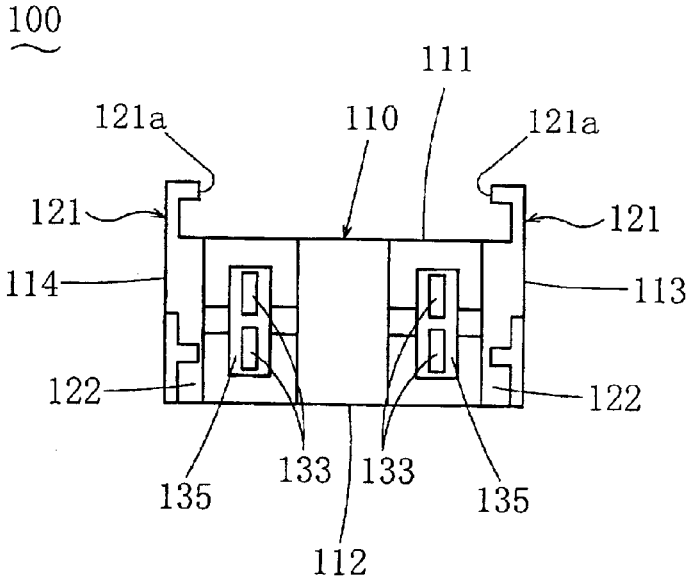
FIG. 17 is a bottom view of the second embodiment of the fuse holder.
Figure 18:
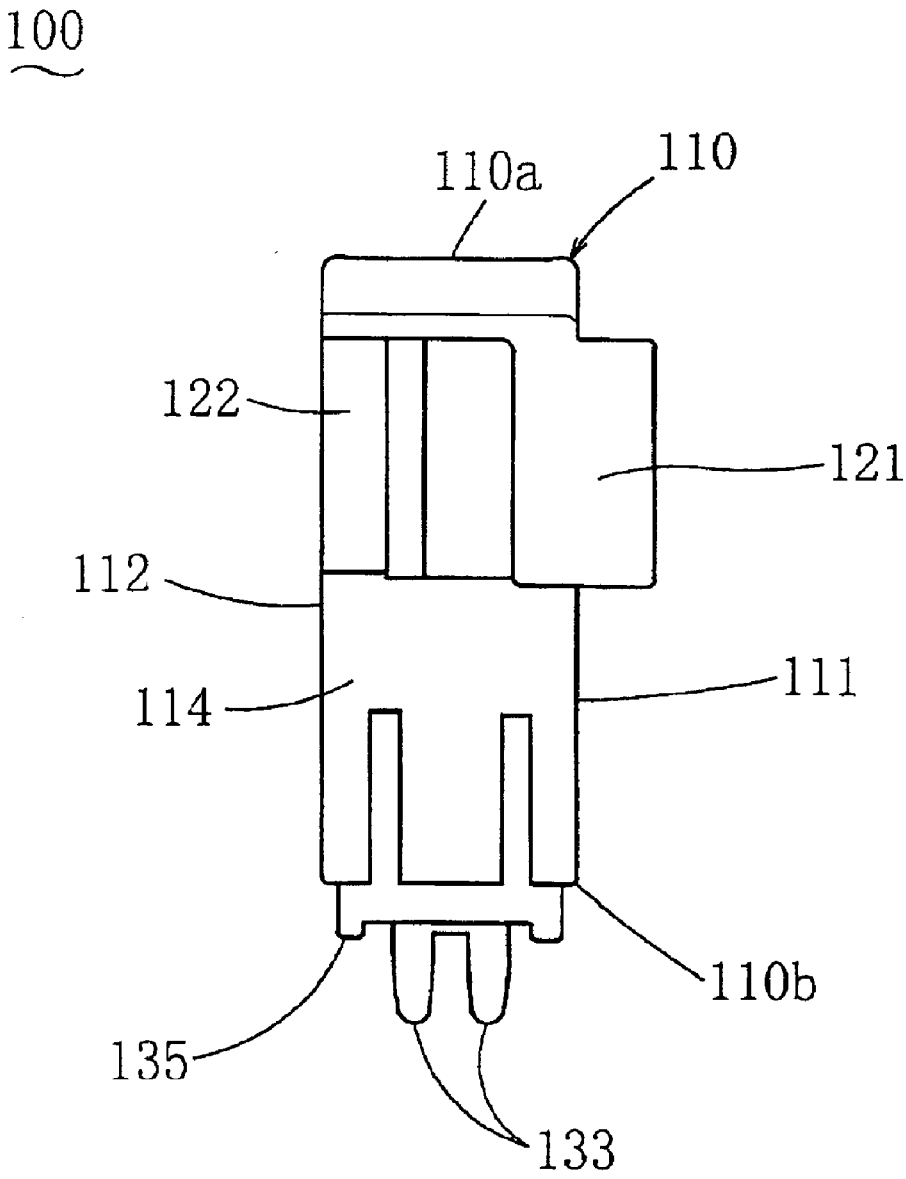
FIG. 18 is a side view of the second embodiment of the fuse holder.
Figure 19:
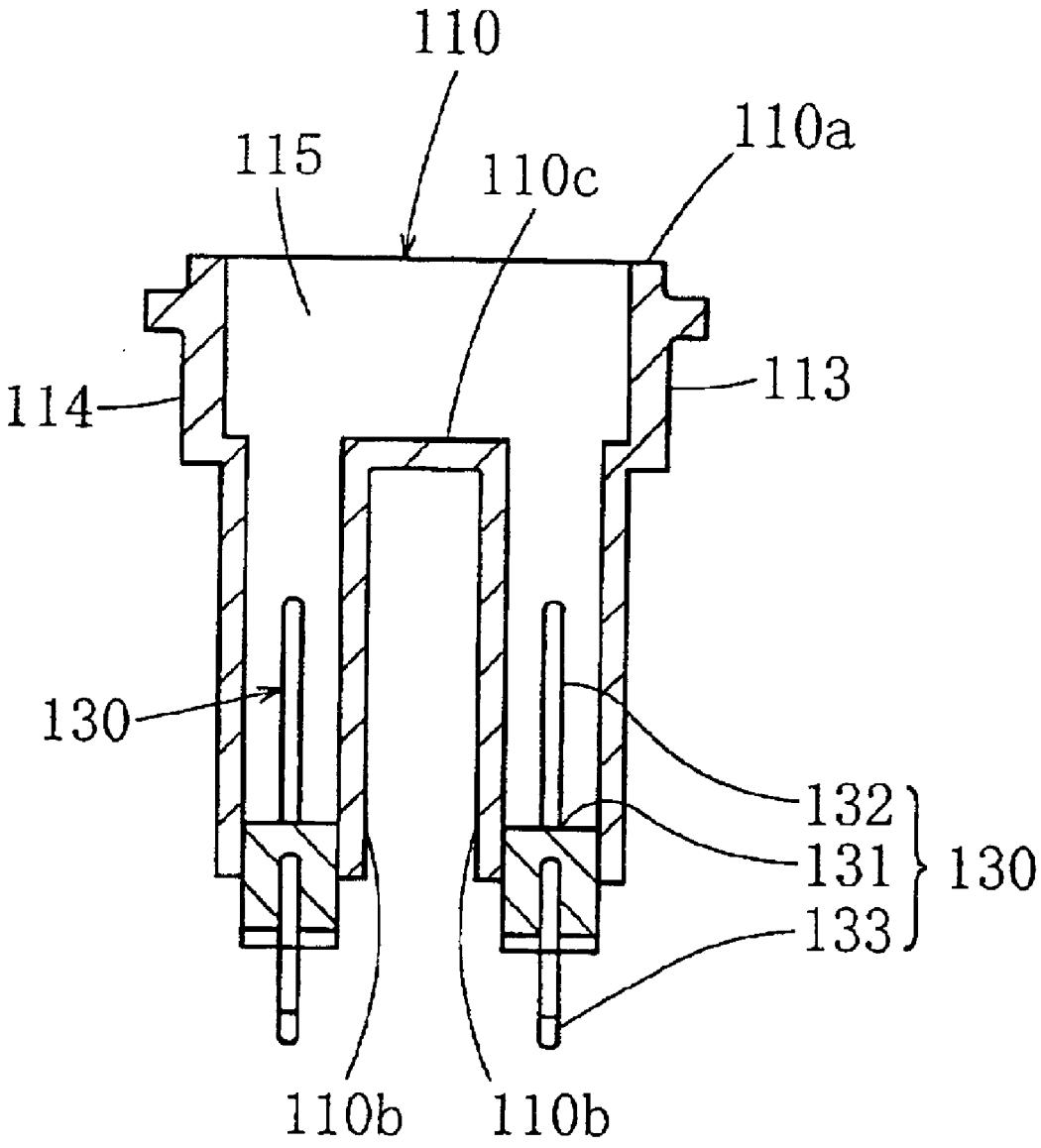
FIG. 19 is a sectional view of the second embodiment of the fuse holder cut in the left wall and the right wall thereof.
Figure 20:
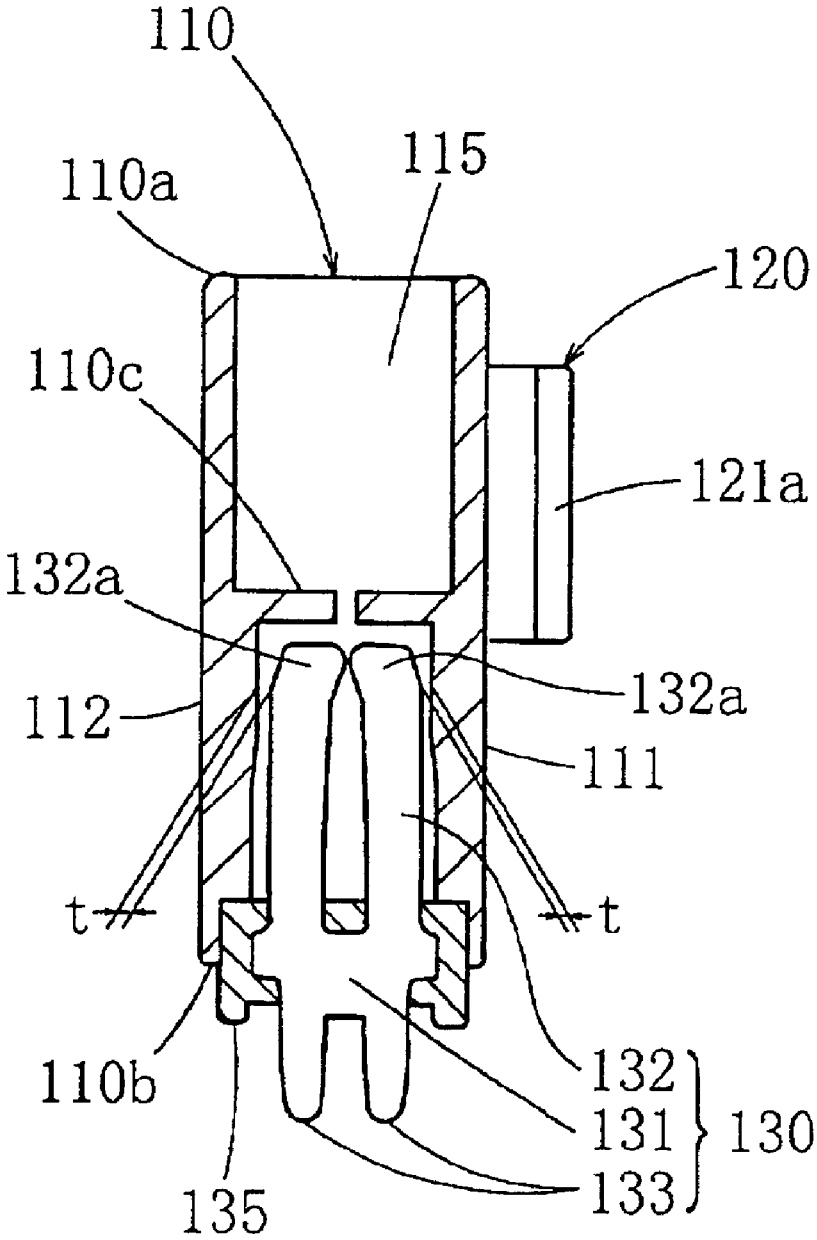
FIG. 20 is a sectional view of the second embodiment of the fuse holder cut in the front wall and the rear wall thereof.

The holder housing 110 is provided with two coupling parts 121, 122. These coupling parts 121, 122 can be disconnectably fitted with two other fuse holders 100 being adjacent to the holder housing 100. Modes of the fitting include modes of fitting by insertion and modes of fitting by frictional force, which are exemplified by Velcro fastener. In this embodiment, two coupling parts 121, 122 fit into the coupling parts 121, 122 of the counterpart fuse holders 100. Of the two coupling parts 121, 122, the first coupling part 121 comprises two plates, which are provided on the front wall 111 and have top ends 121*a* opposing to each other. In plan view, one plate has an inverted L shape, and the other plate has an inverted reversed L shape. The second coupling part 122 comprises ribs, which are provided on the left wall 113 and the right wall 114. The second coupling part 122 extends along the left wall 113 and the right wall 114 in the height direction thereof, and will be held between the top ends 121*a* of the first coupling part 121 and the front wall 111, on which the first coupling part 121 is provided. The coupling parts 121, 122 are integrally formed on the walls 111, 113, 114 of the holder housing 110, and they are formed simultaneously with the holder housing 110. When the fuse holder 100 is to be fitted with another fuse holder 100, as shown in FIG. 12, two fuse holders 100 are held together in such a way that a front wall 111 opposes to a rear wall 112 and the two fuse holders 100 are staggered to each other in the direction of height. Then the top ends 121*a* of the first coupling part 121 of the fuse holder 100 are fitted into the second coupling part 122 of the other fuse holder 100, and the two fuse holders 100 are slid to each other to complete the fitting-in. Thus the two fuse holders 100 are coupled together. The present invention does not limit the locations of the coupling parts 121, 122 to the front wall 111, the left wall 113 and the right wall 114. The coupling parts 121, 122 may be provided on other walls.

Slits 117, into which the side edges 221 of the blade terminals 220 are to be fitted, are provided in the left wall 113 and the right wall 114 of the holder housing 110.

An intermediate part 131 of each contact 130 is fixed to the bottom 110*b* of the holder housing 110. A fork-shaped connecting part 132 is provided on one end of the contact 130 to extend towards the inside of the chamber 115. This connecting part 132 is formed approximately into a U shape, and its two branches 132*a* are arranged to expand towards the front wall 111 and the rear wall 112 to fit with the blade terminal 220 with a certain contact pressure. A leg 133 is provided on the other end of the contact 130 to extend out of the holder housing 110. This leg 133 is soldered or press-fitted onto a printed circuit board 300.

The intermediate part 131 of the contact 130 is enveloped-cast in an insert 135, and the insert 135 is fitted into a space among the walls 111 through 114 at the bottom 110*b* of the holder housing 110. Enveloped-casting means that a material in a molten state adheres to and envelops an object and then solidifies over the object.

The leg 133 of the contact 130 is forked into two branches. In other words, it has two ends.

The clearances t between the connecting part 132 and the front wall 111 and the rear wall 112 of the holder housing 110 are set in such a way that they allow deformation of the connecting part 132 while limiting its excessive deformation. In other words, the clearances t are provided not to hinder expansion of the two branches 132*a* of the connecting part 132 when they are properly pushed by the blade terminal 220 to expand towards the front wall 111 and the rear wall 112. Moreover, the clearances t are provided to hold and prevent excessive deformation of the two branches 132*a* when they are pried by the blade terminal 220.

Figure 11:
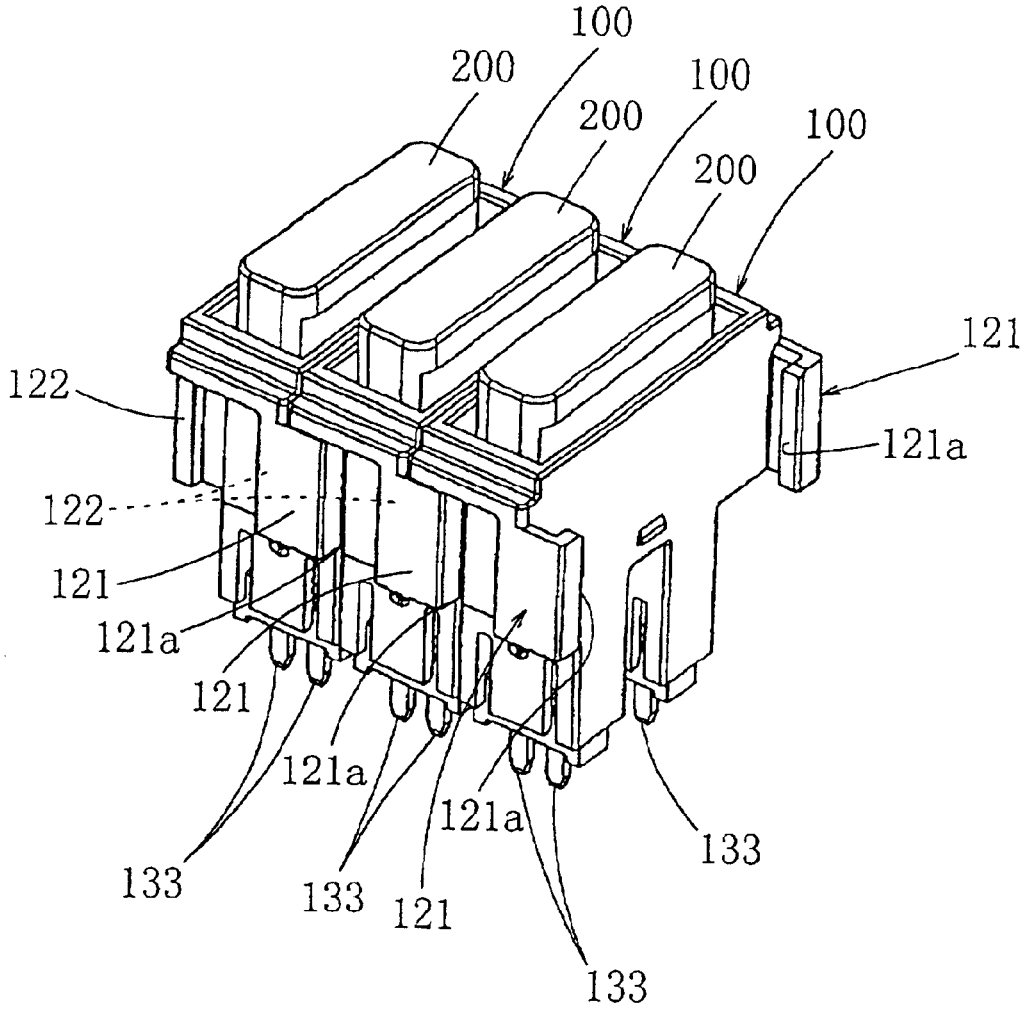
FIG. 11 is a perspective view of the fuse holders of the first embodiment. The fuse folders are coupled to each other, and they are seen from the top side thereof.

Accordingly, in the case of the above-mentioned first embodiment, as shown in FIG. 9 and FIG. 10, when a fuse 200 is fitted into the holder housing 110 of the fuse holder 100, the blade terminals 220 and at least a part of the body 210 will be held in the chamber 115 of the holder housing 110, and the blade terminals 220 will be fitted into the connecting parts 132 of the contacts 130. As shown in FIG. 11, when the fuse holder 100 is coupled to other adjacent fuse holders 100 by means of the coupling parts 121, 122, and the legs 133 of the contacts 130 are soldered or press-fitted onto a printed circuit board 300, the required number of the fuse holders 100 with the fuses 200 fitted in position will be mounted on the printed circuit board 300. When conductive parts such as electric wires are connected to the pattern of the printed circuit board 300, the fuses 200 will be electrically connected to the conductive parts. When the printed circuit board 300 is loaded into a casing or the like, a desired fuse fitting device will be produced. With the use of this fuse holder 100, a fuse fitting device can be produced easily for any number of fuses 200 to be used without newly designing a block. Thus the production cost is reduced. When a fuse fitting device is to be produced, fuses 200 may be fitted into the fuse holders 100 after the plurality of fuse holders 100 being coupled together by means of the coupling parts 121, 122 have been mounted on a printed circuit board 300.

The present invention does not limit the configuration of the connecting part of the contact. For example, the present invention includes embodiments wherein the connecting part is formed with a coiled spring and the contact pressure between the contact and the blade terminal is secured by the coiled spring. Among the embodiments of the present invention, in the case of the above-mentioned first embodiment, the connecting part 132 of the contact 130 is formed into a fork shape that can expand towards the front wall 111 and the rear wall 112, and the clearances t between the connecting part 132 and the front wall 111 and the rear wall 112 of the holder housing 110 are set to allow deformation of the connecting part 132 while limiting its excessive deformation. With these arrangements, as the contact 130 is fork-shaped, the production cost is lower in comparison with a case wherein contacts with coiled spring ends are used. When the connecting part 132 of the contact 130 is deformed, the connecting part 132 will be restrained from excessive deformation by the front wall 111 and the rear wall 112 of the holder housing 110, and in turn, the connecting part 132 will be prevented from being pried by the blade terminal 220.

The present invention does not limit the configuration of the coupling parts by the first embodiment. Among the embodiments of the present invention, in the case of the first embodiment, of the two coupling parts 121, 122, the first coupling part 121 comprises two plates, which are provided on the front wall 111 and have top ends 121*a* opposing to each other. In plan view, one plate has an inverted L shape, and the other plate has an inverted reversed L shape. The second coupling part 122 comprises ribs, which are formed on walls in the height direction to fit with the top ends 121*a* of the first coupling part 121. With this arrangement, when the first coupling part 121 of the fuse holder 100 is fitted with the second coupling part 122 of another adjacent fuse holder 100, the two fuse holders 100 will be coupled together. Moreover, when the second coupling part 122 of the fuse holder 100 is fitted with the first coupling part 121 of another adjacent fuse holder 100, both the fuse holders 100, 100 will be coupled together. In this way, a desired number of the fuse holders 100 of the same configuration can be coupled together.

The present invention includes embodiments wherein the holder housing is not provided with any slit. Among embodiments of the present invention, in the case of the above-mentioned first embodiment, the holder housing 110 is provided with slits 117. With this arrangement, fitting the side edges 221 into the slits 117 will accurately determine the relative positions of the fuse 200 and the fuse holder 100 to each other, and the blade terminals 220 will be prevented from prying the connecting parts 132. Moreover, the fuse 200 will be held more securely in the fuse holder 100.

The present invention does not limit the structure for fixing the intermediate part of the contact to the holder housing. Among the embodiments of the present invention, in the case of the above-mentioned first embodiment, the intermediate part 131 of the contact 130 is enveloped-cast in an insert 135, and this insert 135 is fitted into a space among the walls 111 through 114 at the bottom 110*b* of the holder housing 110. With this arrangement, molding of the holder housing 110 and enveloped-casting of the inserts 135 are made separately, and they can be molded under their respective optimal conditions.

The present invention does not limit the configuration of the leg 133 of the contact 130. Among the embodiments of the present invention, in the case of the above-mentioned first embodiment, the leg 133 of the contact 130 is formed into two branches. With this arrangement, the contact 130 will be connected to the printed circuit board 300 at two points, and defective connection will hardly occur.

In the following, other embodiments will be described. The description of the first embodiment will apply in its entirety as the description of each embodiment, and the same reference character will be used for the same component or part, and only parts that differ in construction from those of the first embodiment will be described.

FIG. 13 through FIG. 24 show the second embodiment fuse holder 100. A mini-type fuse 200 is fitted into this fuse holder 100. In this embodiment, no slit 117 is provided.

Figure 25:
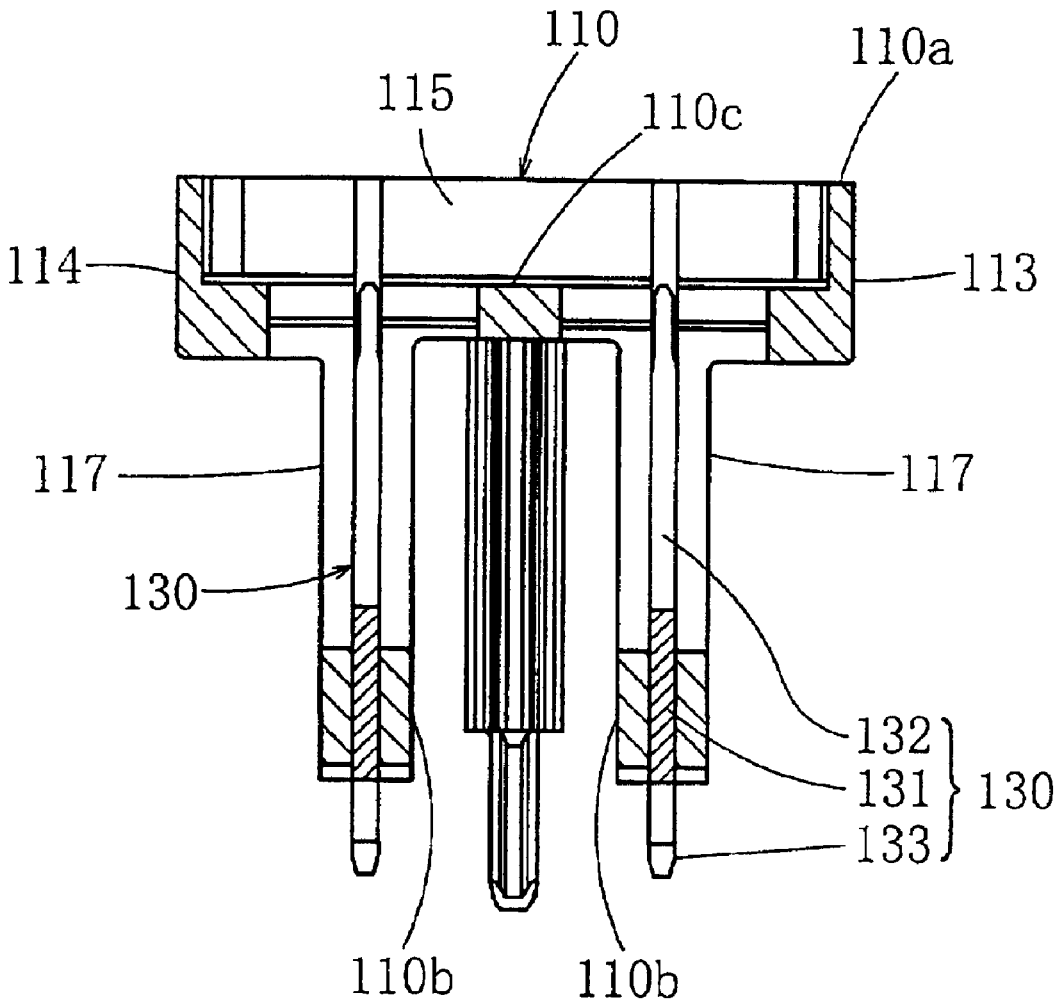
FIG. 25 is a sectional view of the third embodiment of the fuse holder. The fuse holder is cut in both the left wall and the right wall thereof.
Figure 26:
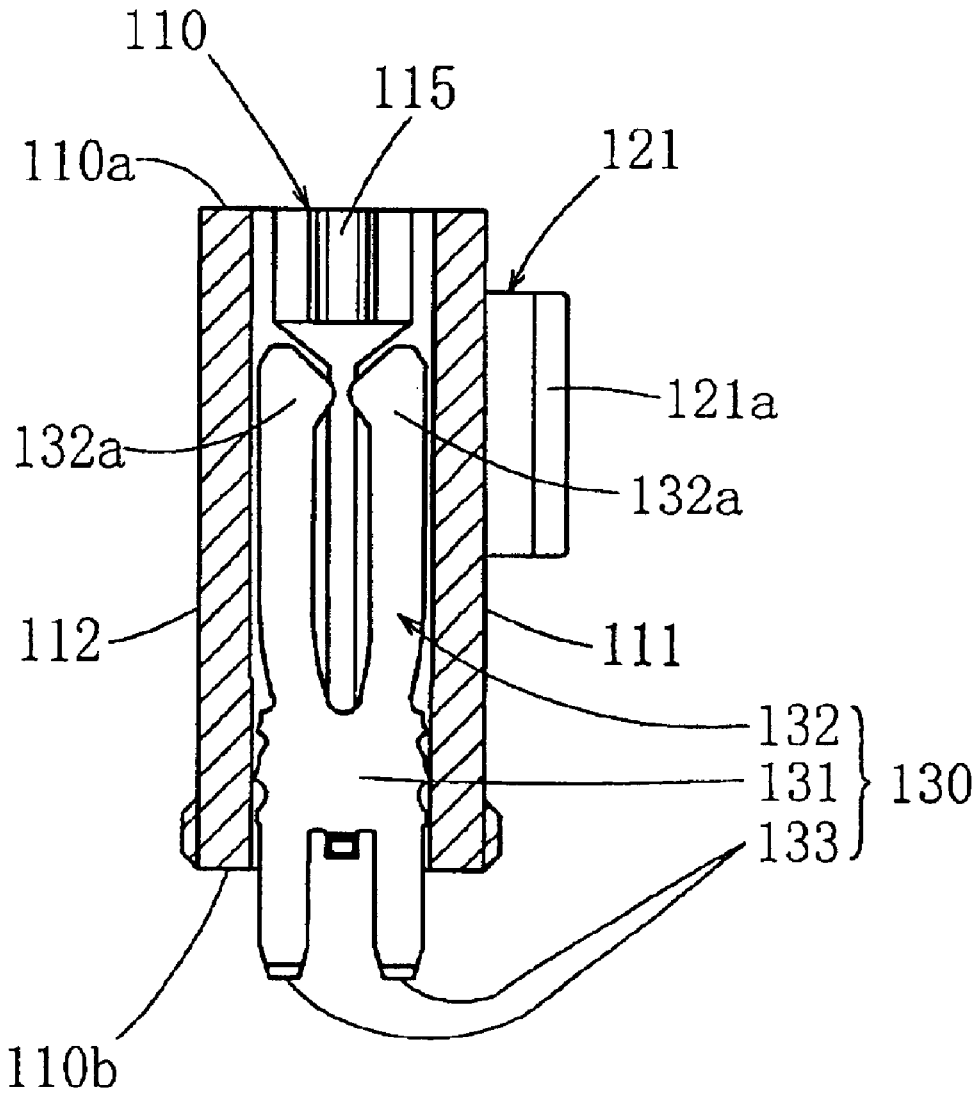
FIG. 26 is a sectional view of the third embodiment of the fuse holder. The fuse holder is cut in both the front wall and the rear wall thereof.

FIG. 25 and FIG. 26 show the third embodiment fuse holder. This embodiment differs from the first embodiment in the method of fixing the contact 130 to the holder housing 110. In the third embodiment, the intermediate parts 131 of the contacts 130 are press-fitted into a space between the walls 111, 112 at the bottom 110*b* of the holder housing 110. With this arrangement, the operation is simpler among the production methods of separately forming the contacts 130 and the holder housing 110 and assembling them together.

Figure 27:
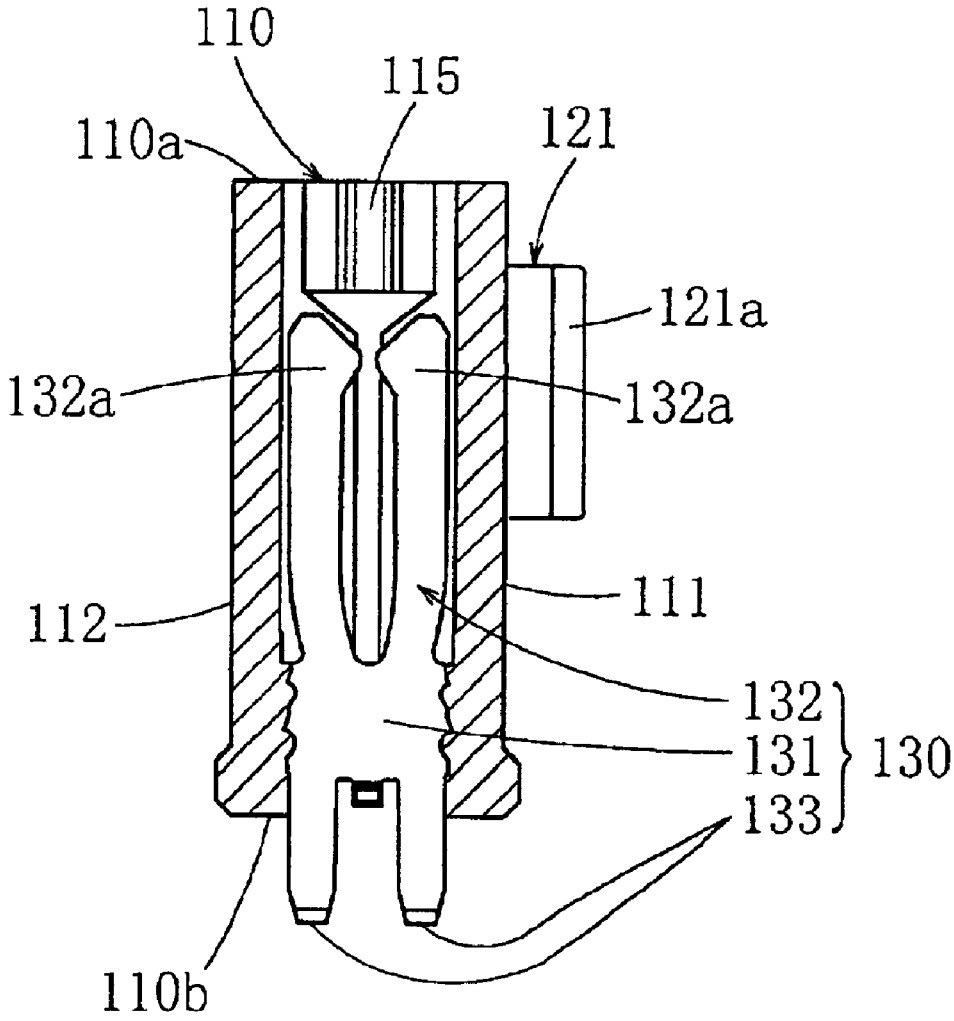
FIG. 27 is a sectional view of the fourth embodiment of the fuse holder. The fuse holder is cut in both the front wall and the rear wall thereof.

FIG. 27 shows the fourth embodiment fuse holder. The fourth embodiment differs from the first embodiment in the method of fixing the contacts 130 to the holder housing 110. In the fourth embodiment, the intermediate parts 131 of the contacts 130 are enveloped-cast in the holder housing 110. When the fuse holder 100 is produced, contacts 130 are set in a mold for the holder housing 110, then the material is filled into the mold to form the holder housing 110. In this way, the relative positions of the contacts 130 and the holder housing 110 to each other will be determined with high precision.

Figure 28:
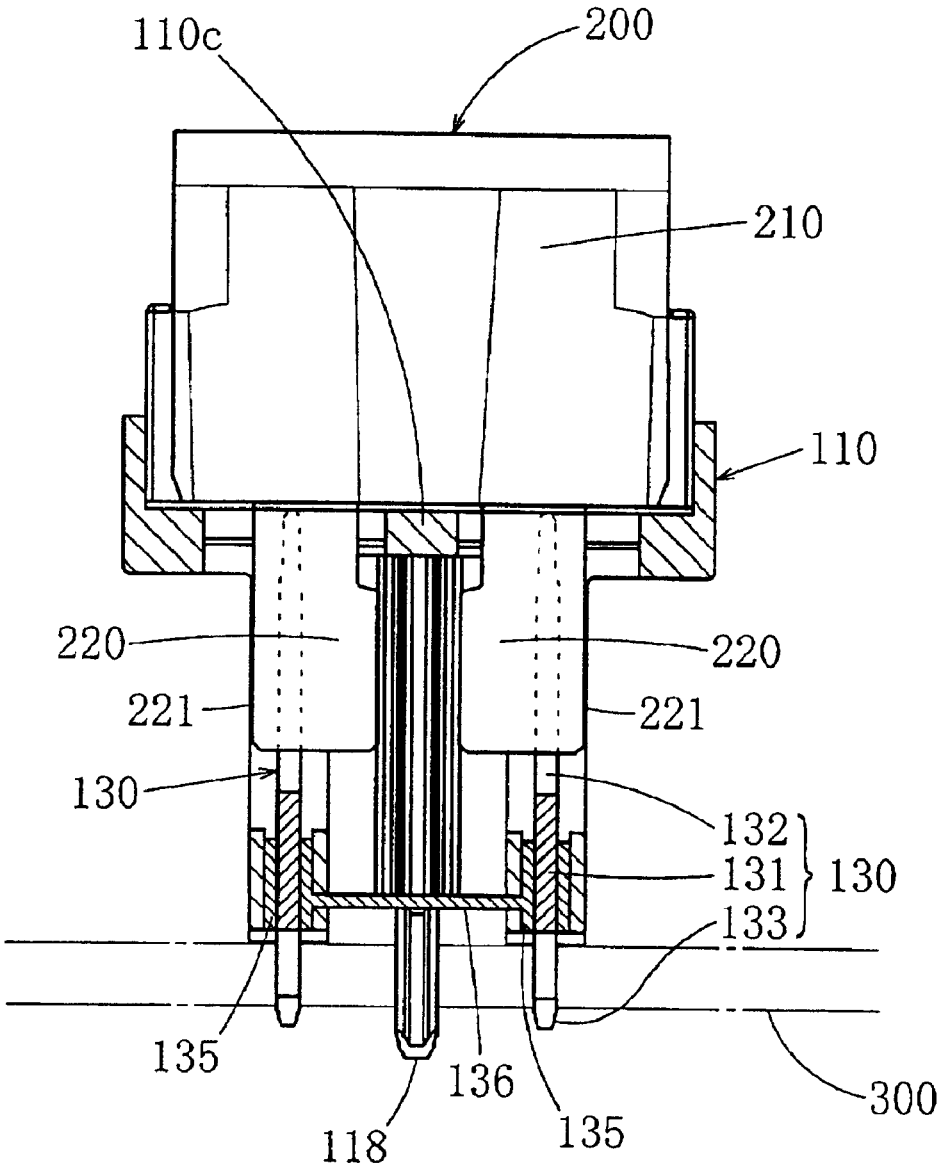
FIG. 28 is a sectional view of the fifth embodiment of the fuse holder. The fuse holder is cut in both the left wall and the right wall.
Figure 29:
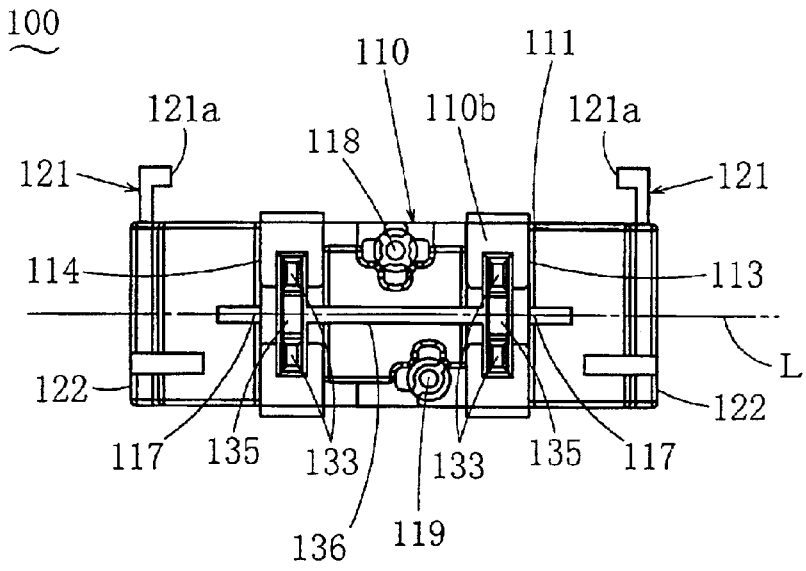
FIG. 29 is a bottom view of the fifth embodiment of the fuse holder.

FIG. 28 and FIG. 29 show the fifth embodiment fuse holder. The fifth embodiment differs from the first embodiment in the configuration of the insert. The two inserts 135 corresponding to the respective contacts 130 are coupled by a bridge 136. With this arrangement, inserting the inserts 135 having the contact 130 into the holder housing 110 can be done by a single operation. In this embodiment, two bosses 118, 119 are provided on the bottom 110*b* of the holder housing 110. These bosses 118, 119 are provided in positions that are asymmetric to each other in relation to a line L, which runs, when seen from the bottom, between the front wall 111 and the rear wall 112 approximately in parallel with these walls. With this arrangement, when holes corresponding to the bosses 118, 119 are made in advance in the printed circuit board 300, mounting, in wrong orientation, of the fuse holder 100 on the printed circuit board 300 will be prevented.

The present invention does not limit the material of the insert 135. However, when the insert 135 is formed of a material, of which heat resistance is superior to that of the holder housing 110, the heat resistance of the holder housing 110 will not pose any problem even if the inserts 135 are subjected to heat of soldering. Hence the holder housing 110 can be made of a more inexpensive material.

Figure 30:
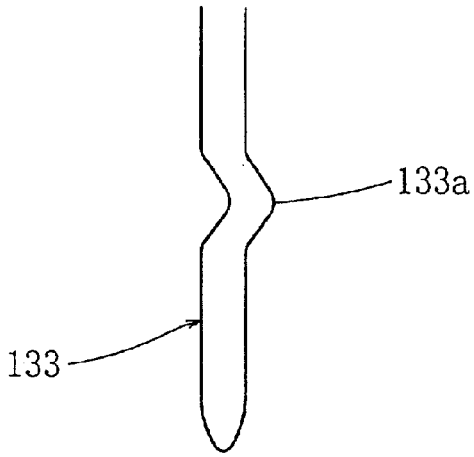
FIG. 30 is an enlarged view showing the leg of the contact of the sixth embodiment of the fuse holder.
Figure 31:
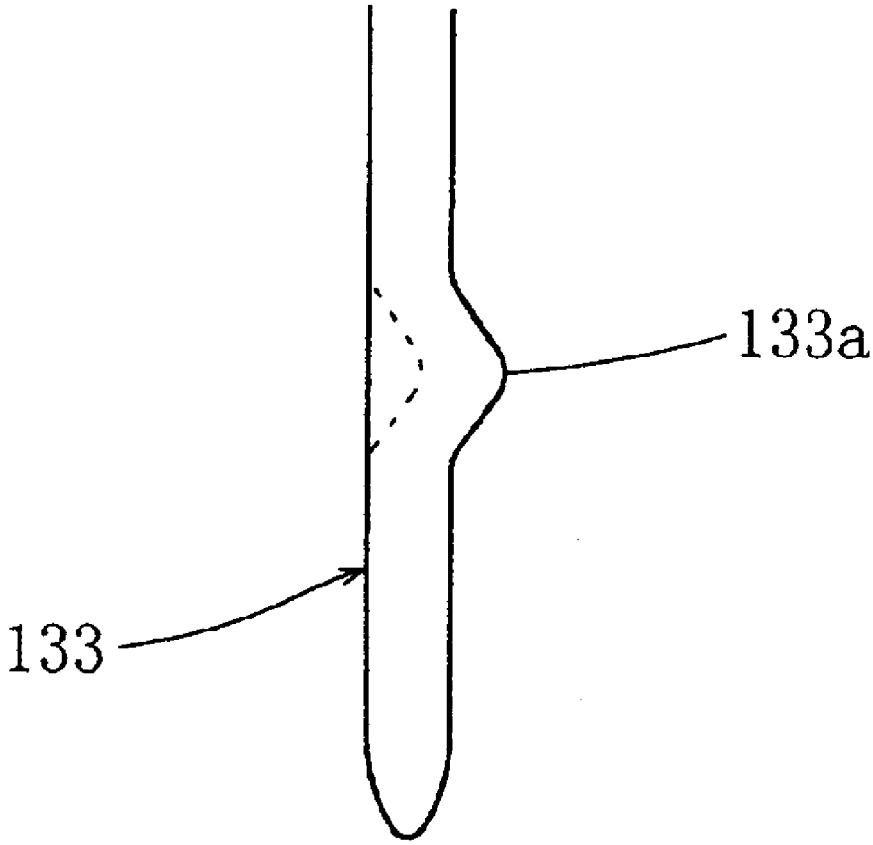
FIG. 31 is an enlarged view showing a modification of the leg of the contact of the sixth embodiment of the fuse holder.

FIG. 30 and FIG. 31 show the sixth embodiment fuse holder. In this embodiment, a protrusion 133*a* is formed in the leg 133 of the contact 130. This protrusion 133*a* is also called a clinch. The protrusion 133*a* may be formed, as shown in FIG. 30, by bending the leg 133 sidewise to form a V shape, or as shown in FIG. 31, by making a part of the leg 133 protrude sidewise. With this arrangement, when the leg 133 of the contact 130 is to be tacked onto a printed circuit board 300 before soldering, fitting the leg 133 of the contact 130 into a hole in the printed circuit board 300 will generate a greater fitting force at the protrusion 133*a*. Thus tacking can be done reliably.

Now, the body 210 of the maxi-type fuse 200, which is used in the first embodiment, is provided with a rib on each side end thereof. The rib is formed parallel to the extending direction of the blade terminals 220. Thus U-shaped supporting parts, which fit with the ribs of the body 210 of the fuse 200, may be provided on the tops of the left wall 113 and the right wall 114 of the holder housing 110. With this arrangement, fitting ribs with the supporting parts will accurately determine the relative positions of the fuse 200 and the fuse holder 100 to each other, and the blade terminals 220 will be prevented from prying the connecting parts 132. Moreover, the fuse 200 will be held in the fuse holder 100 more reliably. It should be noted that the body 210 of the mini-type fuse 200, which is used in the second embodiment, is not provided with the above-mentioned ribs. Hence the holder housing 110 is not provided with such supporting parts.

The present invention does not limit the color of the holder housing 110. However, if the holder housing 110 has the same color as that of the body 210 of the fuse 200, the proper fuse 200 for the fuse holder 100 can be identified easily.

The present invention includes embodiments that combine features of the above-mentioned embodiments.

With the description of these embodiments, the first fuse holder, which was described in the summary of the invention, has been fully disclosed. Moreover, with the description of these embodiments, the second fuse holder through the twelfth fuse holder, which will be described below, have been fully explained.

The second fuse holder is a fuse holder as recited in the above-mentioned first fuse holder, wherein the connecting part of the contact is formed into a fork shape, which can be expanded towards the front wall and the rear wall of the holder housing, and the clearances between the connecting part and the front wall and the rear wall are set in such a way that they allow deformation of the connecting part while limiting its excessive deformation. With this arrangement, as the contact has a fork shape, the production cost is lower than that of a contact having a coiled spring at the top end thereof. When the connecting part of the contact is deformed, the connecting part will be prevented from excessive deformation by the front wall and the rear wall of the holder housing, thus the connecting part will be prevented from being pried by the blade terminal. Hence a high level of performance of the fuse fitting device can be guaranteed.

The third fuse holder is a fuse holder as recited in the above-mentioned first or second fuse holder, wherein, of the two coupling parts, the first coupling part comprises two plates, which are provided on a wall and have top ends opposing to each other, and in plan view, one plate has an inverted L shape, and the other plate has an inverted reversed L shape, and the second coupling part comprises ribs, which are provided on walls, extend in the height direction thereof, and will be held between the top ends of the first coupling part and the wall, on which the first coupling part is provided. With this arrangement, when the first coupling part of the fuse holder is fitted with the second coupling part of another adjacent fuse holder, the two fuse holders will be coupled together. Moreover, when the second coupling part of the fuse holder is fitted with the first coupling part of another adjacent fuse holder, both the fuse holders will be coupled together. In this way, a desired number of the fuse holders of the same configuration can be coupled together.

The fourth fuse holder is a fuse holder as recited in any one of the above-mentioned first through third fuse holders, wherein the intermediate parts of the contacts are press-fitted into a space among the walls of the holder housing. With this arrangement, the operation is simpler among the production methods of separately forming the contacts and the holder housing and assembling them together. Thus the fuse holder can be produced with high efficiency.

The fifth fuse holder is a fuse holder as recited in any one of the above-mentioned first through third fuse holders, wherein the intermediate parts of the contacts are enveloped-cast in the holder housing. With this arrangement, the relative positions of the contacts and the holder housing can be determined with high precision to each other.

The sixth fuse holder is a fuse holder as recited in any one of the above-mentioned first through third fuse holders, wherein the intermediate part of the contact is enveloped-cast in an insert and this insert is fitted into a space among the walls of the holder housing. With this arrangement, molding of the holder housing and enveloped-casting of inserts are made separately, and each can be done under optimal conditions.

The seventh fuse holder is a fuse holder as recited in the above-mentioned sixth fuse holder, wherein two inserts are coupled together. With this arrangement, inserting the inserts having the contact into the holder housing can be done by a single operation. Thus the efficiency of the assembly can be enhanced.

The eighth fuse holder is a fuse holder as recited in the above-mentioned sixth or seventh fuse holder, wherein the insert is formed of a material, of which heat resistance is superior to that of the holder housing. With this arrangement, the heat resistance of the holder housing will not pose any problem even if the insert is subjected to heat of soldering. Hence the holder housing can be made of a more inexpensive material.

The ninth fuse holder is a fuse holder as recited in any one of the above-mentioned first through eighth fuse holders, wherein the leg of the contact is forked into two branches. With this arrangement, the contact will be connected to the printed circuit board at two points, and defective connection between the fuse holder and the printed circuit board can be prevented.

The tenth fuse holder is a fuse holder as recited in any one of the above-mentioned first through ninth fuse holders, wherein a protrusion is formed in the leg of the contact. With this arrangement, when the leg of the contact is to be tacked onto a printed circuit board before soldering, fitting the leg of the contact into a hole in the printed circuit board will generate a greater fitting force at the protrusion. Thus tacking will be done reliably.

The eleventh fuse holder is a fuse holder as recited in any one of the above-mentioned first through tenth fuse holders, wherein the bottom of the holder housing is provided with two bosses in positions that are asymmetric to each other in relation to a line, which runs, when seen from the bottom, between the front wall and the rear wall approximately in parallel with these walls. With this arrangement, when holes corresponding to the bosses are made in advance in the printed circuit board, mounting, in wrong orientation, of the fuse holder on the printed circuit board will be prevented.

The twelfth fuse holder is a fuse holder as recited in any one of the above-mentioned first through eleventh fuse holders, wherein the holder housing has the same color as that of the body of the fuse. With this arrangement, the proper fuse for the fuse holder can be identified easily.

What is claimed is:

1. A fuse holder, into which a blade type fuse, having a body and blade terminals protruding from the body, is fittable, said fuse holder comprising:

a holder housing having wide front and rear walls at the front and the rear and narrow right and left walls on the right and the left, wherein inner wall surfaces of these walls bound a chamber, which will hold the blade terminals and at least a part of the body of the blade type fuse inserted from a top side of the fuse holder, first and second coupling parts that are provided on the holder housing and that are adapted to disconnectably fit the holder housing onto two other holder housings of two other adjacent fuse holders, wherein the first coupling part comprises two plates, which are provided on a first one of the walls and have free protruding ends opposed to each other, and in a plan view, one of the plates has an inverted L shape, and the other one of the plates has an inverted reversed L shape, and the second coupling part comprises ribs, which are provided on second and third ones of the walls, extend in a height direction, and are configured, located and adapted to be held between free protruding ends of an adjacent first coupling part and an adjacent first wall, on which the adjacent first coupling part is provided, of one of the other adjacent fuse holders, and two contacts, each of which has an intermediate part fixed to the holder housing, a connecting part, at one end of the contact, extending into the chamber to fit with one of the blade terminals, and a leg, at another end of the contact, extending out of the holder housing and adapted to be soldered or press-fitted onto a printed circuit board.

2. The fuse holder as recited in claim 1, wherein the first one of the walls on which the two plates of the first coupling part are provided is the front wall, and the second and third ones of the walls on which the ribs of the second coupling part are provided are the right and left walls.

3. The fuse holder as recited in claim 1, wherein the connecting part of at least one of the contacts is formed into a fork shape, which can be flexibly expanded toward the front wall and the rear wall of the holder housing, and clearances are set between the connecting part and the front wall and the rear wall so as to allow limited deformation while limiting excessive deformation of the connecting part.

4. The fuse holder as recited in claim 1, wherein the intermediate parts of the contacts are press-fitted into a space among the walls of the holder housing.

5. The fuse holder as recited in claim 1, wherein the intermediate parts of the contacts are enveloped-cast in the holder housing.

6. The fuse holder as recited in claim 1, wherein the intermediate part of at least one of the contacts is enveloped-cast in an insert and this insert is fitted into a space among the walls of the holder housing.

7. The fuse holder as recited in claim 6, wherein the insert is formed of a material having a heat resistance superior to that of the holder housing.

8. The fuse holder as recited in claim 1, wherein the leg of at least one of the contacts is forked into two branches.

9. The fuse holder as recited in claim 1, wherein a protrusion is formed in the leg of at least one of the contacts.

10. The fuse holder as recited in claim 1, wherein the holder housing has the same color as that of the body of the fuse.

11. A fuse holder, into which a blade type fuse, having a body and blade terminals protruding from the body, is fittable, said fuse holder comprising:

a holder housing having wide front and rear walls at the front and the rear and narrow right and left walls on the right and the left, wherein inner wall surfaces of these walls bound a chamber, which will hold the blade terminals and at least a part of the body of the blade type fuse inserted from a top side of the fuse holder, first and second coupling parts that are provided on the holder housing and that are adapted to disconnectably fit the holder housing onto two other holder housings of two other adjacent fuse holders, and two contacts, each of which has an intermediate part fixed to the holder housing, a connecting part, at one end of the contact, extending into the chamber to fit with one of the blade terminals, and a leg, at another end of the contact, extending out of the holder housing and adapted to be soldered or press-fitted onto a printed circuit board, wherein the intermediate parts of the two contacts are respectively enveloped-cast in respective inserts, which are coupled to each other, and which are respectively fitted into spaces among the walls of the holder housing.

12. The fuse holder as recited in claim 11, wherein the inserts are formed of a material having a heat resistance superior to that of the holder housing.

13. The fuse holder as recited in claim 11, wherein the connecting part of at least one of the contacts is formed into a fork shape, which can be flexibly expanded toward the front wall and the rear wall of the holder housing, and clearances are set between the connecting part and the front wall and the rear wall so as to allow limited deformation while limiting excessive deformation of the connecting part.

14. The fuse holder as recited in claim 11, wherein the leg of at least one of the contacts is forked into two branches.

15. The fuse holder as recited in claim 11, wherein a protrusion is formed in the leg of at least one of the contacts.

16. The fuse holder as recited in claim 11, wherein the holder housing has the same color as that of the body of the fuse.

17. A fuse holder, into which a blade type fuse, having a body and blade terminals protruding from the body, is fittable, said fuse holder comprising:

a holder housing having wide front and rear walls at the front and the rear and narrow right and left walls on the right and the left, wherein inner wall surfaces of these walls bound a chamber, which will hold the blade terminals and at least a part of the body of the blade type fuse inserted from a top side of the fuse holder, first and second coupling parts that are provided on the holder housing and that are adapted to disconnectably fit the holder housing onto two other holder housings of two other adjacent fuse holders, and two contacts, each of which has an intermediate part fixed to the holder housing, a connecting part, at one end of the contact, extending into the chamber to fit with one of the blade terminals, and a leg, at another end of the contact, extending out of the holder housing and adapted to be soldered or press-fitted onto a printed circuit board, wherein the holder housing further has a bottom opposite the top side, and the bottom is provided with two bosses protruding at positions that are asymmetric relative to each other with respect to a line that runs, when seen from the bottom, between the front and rear walls approximately in parallel with the front and rear walls.

18. The fuse holder as recited in claim 17, wherein the connecting part of at least one of the contacts is formed into a fork shape, which can be flexibly expanded toward the front wall and the rear wall of the holder housing, and clearances are set between the connecting part and the front wall and the rear wall so as to allow limited deformation while limiting excessive deformation of the connecting part.

19. The fuse holder as recited in claim 17, wherein the intermediate part of at least one of the contacts is enveloped-cast in an insert and this insert is fitted into a space among the walls of the holder housing.

20. The fuse holder as recited in claim 17, wherein the insert is formed of a material having a heat resistance superior to that of the holder housing.

* * * * *